US007728289B2

(12) United States Patent
Naya et al.

(10) Patent No.: US 7,728,289 B2
(45) Date of Patent: Jun. 1, 2010

(54) MASS SPECTROSCOPY DEVICE AND MASS SPECTROSCOPY SYSTEM

(75) Inventors: Masayuki Naya, Ashigarakami-gun (JP); Jingbo Li, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 176 days.

(21) Appl. No.: 12/126,067

(22) Filed: May 23, 2008

(65) Prior Publication Data

US 2008/0290272 A1 Nov. 27, 2008

(30) Foreign Application Priority Data

May 24, 2007 (JP) ..... 2007-137876

(51) Int. Cl.
*H01J 49/40* (2006.01)

(52) U.S. Cl. ..... 250/288

(58) Field of Classification Search ..... 250/288, 250/287; 356/445

See application file for complete search history.

(56) References Cited

U.S. PATENT DOCUMENTS 6,476,409 B2 11/2002 Iwasaki et al.
6,610,463 B1 8/2003 Ohkura et al.
6,784,007 B2 8/2004 Iwasaki et al.
6,924,023 B2 8/2005 Ohkura et al.
6,956,651 B2 * 10/2005 Lackritz et al. ..... 356/445

FOREIGN PATENT DOCUMENTS

JP 09-320515 A 12/1997

* cited by examiner

*Primary Examiner*—Kiet T Nguyen
(74) *Attorney, Agent, or Firm*—Sughrue Mion, PLLC

(57) ABSTRACT

A mass spectroscopy device constituted by a first reflector which is partially transparent and partially reflective, a transparent body, and a second reflector which is reflective. The first reflector and the second reflector are arranged on opposite sides of the transparent body so as to form an optical resonator in such a manner that when a specimen containing an analyte subject to mass spectroscopy is arranged in contact with a surface of the first reflector, and the surface is irradiated with measurement light, optical resonance occurs in the optical resonator, and intensifies an electric field on the surface, and the intensified electric field desorbs the analyte from the surface.

22 Claims, 11 Drawing Sheets

MASS SPECTROSCOPY DEVICE AND MASS SPECTROSCOPY SYSTEM

BACKGROUND OF THE INVENTION

1. Field of the Invention

The present invention relates to a mass spectroscopy device for use in a process of performing mass spectroscopy of a material to be analyzed (analyte) which is contained in a specimen arranged in contact with the mass spectroscopy device by irradiating the specimen with light so as to desorb the analyte from a surface of the mass spectroscopy device. The present invention also relates to a mass spectroscopy system having the above mass spectroscopy device. The present invention further relates to a microstructure which uses optical resonance in an optical resonator.

2. Description of the Related Art

The mass spectroscopy is used for identifying materials. In a known technique of performing mass spectroscopy of an analyte which is contained in a specimen, the specimen is arranged in contact with a mass spectroscopy device, and irradiated with measurement light (i.e., light applied to the mass spectroscopy device for measurement) so as to desorb the analyte from a surface of the mass spectroscopy device for the mass spectroscopy. Then, the desorbed analyte is identified by detecting the mass of particles constituting the desorbed analyte, for example, by the time-of-flight mass spectroscopy (TOF-MS). In the TOF-MS, the particles constituting the desorbed analyte are accelerated so that the particles fly over a predetermined distance, and the time of the flight (in which the mass of the particles are reflected) is detected.

In the above technique of mass spectroscopy, the desorption of the particles of the analyte are realized by ionization of the analyte. However, in the case where the analyte is a material which is hard to evaporate (e.g., a biological material or the like), or a high-molecular-weight material such as a synthesized macromolecule, it is difficult to desorb the analyte. Therefore, various techniques enabling mass spectroscopy of the hard-to-evaporate materials and the high-molecular-weight materials have been studied. Nevertheless, the types and the molecular weight of the materials of which the mass spectroscopy can be performed are still limited.

The field-desorption mass spectroscopy (FD-MS), the fast-atom-bombardment mass spectroscopy (FAB-MS), the matrix-assisted laser desorption ionization (MALDI), and the like are currently known as techniques of mass spectroscopy for the hard-to-evaporate materials and the high-molecular-weight materials. Among others, the MALDI technique is known as a technique of mass spectroscopy which chemically affects the specimen to a relatively small degree, and enables measurement of analytes which have molecular weight exceeding ten thousand.

In the MALDI technique, a specimen is prepared by mixing an analyte in a matrix of sinapinic acid, glycerin, or the like, and is then irradiated with laser light so that the matrix absorbs the energy of the laser light and evaporates together with the analyte, and the analyte is ionized by proton transfer between the matrix and the analyte. Although, currently, use of the MALDI-TOF mass spectroscopy is widely spreading in the fields of biological materials and synthesized macromolecules, techniques for enabling more precise analysis in the MALDI-TOF mass spectroscopy have been studied, for example, as disclosed in Japanese Unexamined Patent Publication No. 9(1997)-320515.

In the MALDI-TOF mass spectroscopy, the matrix, as well as the analyte, is ionized, so that the matrix material also fly, is detected, and produces noise. Therefore, the sensitivity in the mass spectroscopy is likely to be lowered by the noise.

In addition, although the MALDI-TOF technique can be used in mass spectroscopy of the biological materials and synthesized macromolecules, high-energy laser light is necessary. Since the high-energy laser-light source is currently expensive, the use of the MALDI-TOF technique increases the equipment cost and therefore increases the measurement cost.

SUMMARY OF THE INVENTION

The present invention has been made in view of the above circumstances.

The first object of the present invention is to provide a mass spectroscopy device for use in a process of performing mass spectroscopy of an analyte which is contained in a specimen arranged in contact with the mass spectroscopy device by irradiating the specimen with measurement light so as to desorb the analyte from a surface of the mass spectroscopy device, where the mass spectroscopy device enables mass spectroscopy with high precision by use of the measurement light having low energy.

The second object of the present invention is to provide a mass spectroscopy system realizing high-precision mass spectroscopy by use of low-energy measurement light.

The third object of the present invention is to provide a microstructure which can be used in various devices taking advantage of optical absorption associated with optical resonance in an optical resonator.

(I) In order to accomplish the above first object, a mass spectroscopy device according to the first aspect of the present invention is provided. The mass spectroscopy device according to the first aspect of the present invention comprises a first reflector which is partially transparent and partially reflective; a transparent body; and a second reflector which is reflective. The first reflector and the second reflector are arranged on opposite sides of the transparent body so as to form an optical resonator in such a manner that when a specimen containing an analyte subject to mass spectroscopy is arranged in contact with a surface of the first reflector, and the surface is irradiated with measurement light, optical resonance occurs in the optical resonator, and intensifies an electric field on the surface, and the intensified electric field desorbs the analyte from the surface.

In this specification, the expression "partially transparent and partially reflective" means to have both of transparency and reflectivity, where the transmittance and the reflectance are not specifically limited.

The mass spectroscopy device according to the first aspect of the present invention includes the optical resonator formed by the transparent body sandwiched by the first and second reflectors. Therefore, when the surface of the first reflector is irradiated with measurement light, part of the measurement light passes through the first reflector, enters the transparent body, and is multiply reflected between the first reflector and the second reflector, so that the multiply reflected light effectively causes multiple interference and resonance. The resonance effectively intensifies the electric field on the surface of the first reflector, and increases the energy of the measurement light on the surface of the first reflector. Thus, the mass spectroscopy device according to the first aspect of the present invention can decrease the energy of the incident measurement light and the equipment cost.

In addition, the mass spectroscopy device according to the first aspect of the present invention enables desorption of the analyte without use of other materials which are desorbed concurrently with the analyte and produce noise in mass spectroscopy. Therefore, the mass spectroscopy device according to the first aspect of the present invention can increase the sensitivity in the mass spectroscopy.

Preferably, the mass spectroscopy device according to the first aspect of the present invention may have one or any possible combination of the following additional features (i) to (xvi).

(i) The specimen may contains a mixture of the analyte and a matrix material, the analyte and the matrix material are desorbed from the surface of the first reflector and ionized when the surface is irradiated with the measurement light.

(ii) The analyte is ionized and desorbed from the surface of the first reflector when the surface is irradiated with the measurement light.

(iii) The first reflector has a structure of protrusions and recesses which is finer than the wavelength of the measurement light.

In this specification, the expression "a structure of protrusions and recesses which is finer than the wavelength of the measurement light" means a structure having protrusions and recesses in which the average dimensions (the average of the maximum widths) of the protrusions and the recesses and the average pitch between the protrusions (or the average pitch between the recesses) are smaller than the wavelength of the measurement light, where the recesses include through holes in the first reflector.

(iv) In the mass spectroscopy device having the feature (iii), the first reflector is constituted by a metal layer formed in a pattern on a surface of the transparent body.

(v) In the mass spectroscopy device having the feature (iii), the first reflector is constituted by a metal layer which is formed with noncohesive metal particles fixed to a surface of the transparent body.

In this specification, the "noncohesive metal particles" include metal particles which do not gather (i.e., metal particles which are separated from each other), and metal particles separated into groups in each of which metal particles are irreversibly and integrally combined.

(vi) In the mass spectroscopy device having the feature (iii), the transparent body is constituted by a transparent microporous body having micropores which are open at the ends on the first-reflector side, the micropores have diameters smaller than the wavelength of the measurement light, and the first reflector is constituted by a metal layer having microholes formed in a pattern corresponding to the surface profile of the transparent body.

(vii) In the mass spectroscopy device having the feature (vi), the transparent microporous body is realized by an anodically oxidized portion of a metal body, the second reflector is realized by an unoxidized portion of the metal body, and the metal layer is formed on the transparent body.

(viii) In the mass spectroscopy device having the feature (vi), at least part of the micropores are filled with metal.

(ix) In the mass spectroscopy device having the feature (viii), bottom portions of the micropores are filled with metal.

(x) In the mass spectroscopy device having the feature (iii), the transparent body is constituted by a transparent microporous body having micropores which are open at the ends on the first-reflector side, metal microbodies are respectively fixed to the micropores, the metal microbodies are constituted by metal-filler portions and metal protrusions, the micropores are filled with metal-filler portions, and the metal protrusions are formed so as to protrude above a surface of the transparent body and have greater diameters than the metal-filler portions.

(xi) In the mass spectroscopy device having the feature (x), the transparent microporous body is realized by an anodically oxidized portion of a metal body, the second reflector is realized by an unoxidized portion of the metal body, and the first reflector is realized by the metal protrusions.

(xii) In the mass spectroscopy device having the feature (iii), the first reflector comprises a columnar metal film formed on a surface of the transparent body, and the columnar metal film is constituted by a plurality of columns which extend approximately parallel to each other and nonparallel to the surface of the transparent body.

(xiii) In the mass spectroscopy device having the feature (iii), the first reflector comprises a columnar dielectric film and a metal film, the columnar dielectric film is formed on a surface of the transparent body, and the columnar dielectric film is constituted by a plurality of columns which extend approximately parallel to each other and nonparallel to the surface of the transparent body, and the metal film is formed on the columnar dielectric film.

(xiv) Localized plasmon can be excited at least the surface of the first reflector, and the measurement light contains a component having such a wavelength that the component can excite localized plasmon in the first reflector.

(xv) Surface modification which can be combined with the analyte is applied to the surface of the first reflector, the surface modification is constituted by a first linker, a second linker, and a decomposer, the first linker is combined with the surface of the first reflector, and the second linker is combined with the analyte, the decomposer is interposed between the first linker and the second linker, and decomposed by an electric field generated by irradiation of the surface of the first reflector with the measurement light.

(xvi) A position marking for identifying a target position at which the specimen is to be analyzed is arranged at a marking position which can be detected from outside.

(II) In order to accomplish the second object, a mass spectroscopy system according to the second aspect of the present invention is provided. The mass spectroscopy system according to the second aspect of the present invention comprises: the mass spectroscopy device according to the first aspect of the present invention; a first irradiation unit which applies the measurement light to the surface of the first reflector with which the specimen is arranged in contact, and desorbs the analyte from the surface; and an analysis unit which detects the desorbed analyte, and performs mass spectroscopy of the analyte. The mass spectroscopy system may further have one or any possible combination of the aforementioned additional features (i) to (xvi).

Since the mass spectroscopy system according to the second aspect of the present invention uses the mass spectroscopy device according to the first aspect of the present invention, the mass spectroscopy system can also have the advantages of the mass spectroscopy device. That is, the mass spectroscopy system according to the second aspect of the present invention can decrease the energy of the incident measurement light and the equipment cost, and achieve high sensitivity in mass spectroscopy.

Preferably, the mass spectroscopy system according to the second aspect of the present invention may have one or any possible combination of the following additional features (xvii) to (xix).

(xvii) The mass spectroscopy system according to the second aspect of the present invention may further comprise a second irradiation unit which applies detection light to a target position on the surface of the first reflector with which the specimen is arranged in contact, and intensifies the electric field on the target position on the surface, and a detection unit which detects the presence or absence of the analyte in the specimen at the target position on the surface by using the intensified electric field, where the analysis unit performs mass spectroscopy of the analyte while applying the detection light to the target position on the surface of the first reflector.

(xviii) In the mass spectroscopy system having the feature (xvii), a position marking for identifying the target position is arranged at a marking position which can be detected from outside, and the mass spectroscopy system further comprises a positioning means which makes a first position to which the measurement light is applied coincide with a second position to which the detection light by referring to the position marking.

(xix) In the mass spectroscopy system according to the second aspect of the present invention, the analysis unit performs time-of-flight mass spectroscopy.

(III) In order to accomplish the third object, a microstructure according to the third aspect of the present invention is provided. The microstructure according to the third aspect of the present invention comprises: a first reflector which is partially transparent and partially reflective; a transparent body; and a second reflector which is reflective. The first reflector is realized by a columnar film formed on a surface of the transparent body, and the columnar film is constituted by a plurality of columns which extend approximately parallel to each other and nonparallel to the surface of the transparent body, and the first reflector and the second reflector are arranged on opposite sides of the transparent body so as to form an optical resonator in such a manner that optical resonance occurs in the optical resonator when a surface of the first reflector is irradiated with measurement light.

DESCRIPTION OF PREFERRED EMBODIMENTS

Figure 1A:
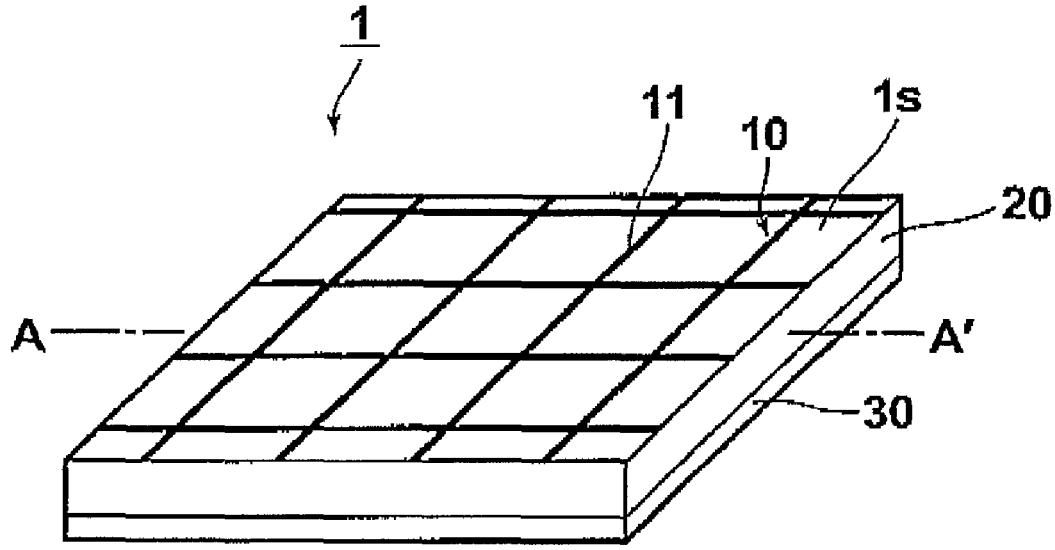
FIG. 1A is a perspective view of a mass spectroscopy device according to a first embodiment of the present invention.

Preferred embodiments of the present invention are explained in detail below with reference to drawings. In the drawings, equivalent elements and constituents are indicated by the same reference numbers even in drawings for different embodiments, and descriptions of the equivalent elements or constituents are not repeated unless necessary.

1. First Embodiment

The mass spectroscopy device according to the first embodiment is explained below with reference to FIGS. 1A and 1B. FIG. 1A is a perspective view of the mass spectroscopy device according to the first embodiment, and FIG. 1B is a cross-sectional view illustrating the A-A' cross section of the mass spectroscopy device of FIG. 1A along the thickness direction.

Figure 1B:
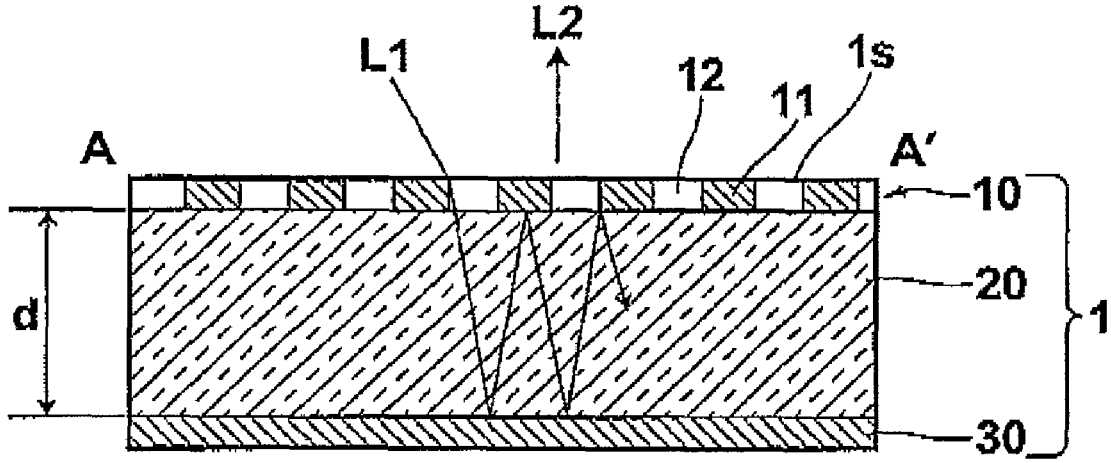
FIG. 1B is a cross-sectional view illustrating a cross section, along the thickness direction, of the mass spectroscopy device of FIG. 1A.

As illustrated in FIGS. 1A and 1B, the mass spectroscopy device 1 has a structure constituted by a first reflector 10, a transparent body 20, and a second reflector 30. The first reflector 10 is arranged on the light-injection side (the upper side in FIG. 1A) of the transparent body 20, and the second reflector 30 is arranged on the opposite side of the transparent body 20. The first reflector 10 is partially transparent and partially reflective, and the second reflector 30 is reflective. The (upper) surface of the first reflector 10 is a specimen-contact surface 1*s* of the mass spectroscopy device 1, with which a specimen is to be arranged in contact. Measurement light L1 is applied from the light-injection side (the upper side in FIG. 1A) of the mass spectroscopy device 1. The measurement light L1 is laser light, and the wavelength of the measurement light L1 is chosen according to the analyte.

The transparent body 20 is realized by a planar transparent substrate. The first reflector 10 is realized by arranging fine metal wires 11 on the first surface (the upper surface in FIGS. 1A and 1B) of the transparent body 20 in a regular grid pattern, and the second reflector 30 is realized by a solid metal layer formed over the entire second surface (the lower surface in FIGS. 1A and 1B) of the transparent body 20.

The material of the transparent body 20 is not specifically limited. For example, the transparent body 20 may be made of a transparent ceramic material (such as glass or alumina), a transparent resin (such as acrylic resin or carbonate resin), or the like. The metal wires 11 and the second reflector 30 may be made of a reflective metal, for example, Au, Ag, Cu, Al, Pt, Ni, Ti, or an alloy of two or more of these reflective metals. Alternatively, the metal wires 11 and the second reflector 30 may be made of two or more types of reflective metals.

The second reflector 30 may be formed, for example, by metal evaporation. The grid pattern of the metal wires 11 in the first reflector 10 can be realized, for example, by forming a solid metal layer over the entire first surface of the transparent body 20, and then forming the grid pattern by well-known photolithography.

Although the metal wires 11 constituting the first reflector 10 are formed of the reflective metal, a plurality of spaces (gaps) 12 exist between the metal wires 11. Therefore, the first reflector 10 is transparent at the plurality of spaces (gaps) 12, so that the first reflector 10 becomes partially transparent and partially reflective as a whole. The width of the metal wires 11 and the pitch of the grid pattern are designed to be smaller than the wavelength of the measurement light L1. That is, the first reflector 10 has a structure of projections and recesses finer than the wavelength of the measurement light L1. In this case, the first reflector 10 behaves as a thin film which exhibits the electromagnetic shield effect, and is partially transparent and partially reflective.

Although the pitch of the grid pattern of the metal wires 11 is not specifically limited as long as the pitch is smaller than the wavelength of the measurement light L1, it is more preferable that the grid pattern have a smaller pitch, and for example, the pitch is preferably 200 nm or smaller in the case where the measurement light L1 is visible light. Although the width of the metal wires 11 is not specifically limited as long as the width is smaller than the wavelength of the measurement light L1, it is more preferable that the metal wires 11 have a smaller width. The width of the metal wires 11 is preferably equal to or smaller than the mean free path of the electrons which vibrate in the metal by the action of the measurement light L1. Specifically, the width is preferably equal to or smaller than 50 nm, and more preferably equal to or smaller than 30 nm.

Although the thickness of the transparent body 20 is not specifically limited, it is preferable that the thickness of the transparent body 20 be 300 nm or smaller, since, in this case, only one absorption peak is produced by multiple interference in the visible-light wavelength range, so that the absorption peak can be easily detected. In addition, it is also preferable that the thickness of the transparent body 20 be 100 nm or greater, since, in this case, the multiple interference effectively occurs, and the absorption peak can be easily detected in the visible-light wavelength range.

It is possible to change the resonant wavelength of the mass spectroscopy device 1 according to the thickness and the average refractive index of the transparent body 20 in the present embodiment. The thickness and the average refractive index of the transparent body 20 are related as expressed by the approximate equation, $$\lambda \approx 2nd/(m+1) \quad (1)$$

where d is the thickness of the transparent body 20, λ is the resonant wavelength, n is the average refractive index of the transparent body 20, and m is an integer. Therefore, when the average refractive index n of the transparent body 20 is unchanged, the resonant wavelength λ of the mass spectroscopy device 1 can be changed by only changing the thickness d of the transparent body 20.

In the case where the transparent body 20 contains micropores (as in the third embodiment explained later), the average refractive index n is an average of the refractive indexes of the micropores and the other portions of the transparent body 20. For example, the refractive index of the micropores is the refractive index of the air when the micropores is not filled with a material, or is the refractive index of a filler of the micropores when the micropores is filled with the filler, or is the average of the refractive indexes of a filler and the air in the micropores when the micropores is partially filled with the filler.

Although the refractive index of a material is a complex number when the material absorbs light, the imaginary component of the transparent body 20 is zero. Even when the transparent body 20 contains the micropores, the influence of the filler in the micropores is small. Therefore, the refractive index of the transparent body 20 is approximated by the real number n in the approximate equation (1).

Although the resonant condition in the mass spectroscopy device 1 varies with the physical characteristics and the surface conditions of the first reflector 10 and the second reflector 30, the resonant wavelength can be determined by using the approximate equation (1) with the precision on the order of several nanometers since the variations in the resonant condition caused by the physical characteristics and the surface conditions of the first reflector 10 and the second reflector 30 are smaller than the influence of the thickness and the average refractive index of the transparent body 20.

As illustrated in FIG. 1B, when the measurement light L1 is injected onto the mass spectroscopy device 1, first part of the measurement light L1 is reflected at the surface of the first reflector 10 (although not shown), and second part of the measurement light L1 passes through the first reflector 10 and enters the transparent body 20, where the first and second parts are determined according to the transmittance and reflectance of the first reflector 10. Then, the second part of the measurement light L1 is repeatedly reflected between the first reflector 10 and the second reflector 30. That is, the mass spectroscopy device 1 has a resonance structure which causes multiple reflection between the first reflector 10 and the second reflector 30.

In the above mass spectroscopy device 1, the multiply reflected light causes multiple interference, so that the mass spectroscopy device 1 exhibits an absorption characteristic that light at a specific wavelength satisfying a resonant condition (i.e., the resonant wavelength) resonates and is selectively absorbed. Therefore, the mass spectroscopy device 1 outputs output light L2 having a physical characteristic which is different from the physical characteristic of the incident measurement light L1 and depends on the above absorption characteristic. In addition, the electric field inside the mass spectroscopy device 1 is intensified, so that the effect of intensifying the electric field on the specimen-contact surface 1*s* of the mass spectroscopy device 1 (i.e., the upper surface of the first reflector 10) works.

It is preferable that the mass spectroscopy device 1 have a structure in which the optical impedance is matched so as to maximize the number of the multiple reflections in the transparent body 20 (i.e., to maximize the finesse). In this case, the absorption peak is sharpened, and the electric field can be more effectively intensified.

The mass spectroscopy device 1 is used in a process of performing mass spectroscopy of an analyte S. In the process, the analyte S is contained in a specimen arranged in contact with the mass spectroscopy device 1, the specimen is irradiated with the measurement light L1 so as to desorb the analyte S from the specimen-contact surface Is (i.e., the upper surface of the first reflector 10) of the mass spectroscopy device. Since the electric field is intensified on the specimen-contact surface 1*s*, the energy of the measurement light L1 is increased on the specimen-contact surface 1*s*, so that the increased energy enables desorption of the analyte S from the specimen-contact surface 1*s*.

The manner of the desorption of the analyte S is not specifically limited, and can be chosen according to the type of the mass spectroscopy technique. For example, the analyte S may be desorbed into a state in which the analyte S is combined with or dispersed in another material, or the analyte S may be desorbed by ionizing the analyte S.

Further, in the case where the first reflector 10 is formed of metal containing free electrons, and has a structure of protrusions and recesses with such dimensions that localized plasmon can be induced, it is possible to cause localized plasmon resonance in the first reflector 10 when the measurement light L1 injected onto the first reflector 10 contains a component at a wavelength which can excite localized plasmon in the first reflector 10. Since the mass spectroscopy device 1 according to the first embodiment has a structure of protrusions and recesses which is finer than the wavelength of the measurement light L1, it is possible to excite the localized plasmon in the mass spectroscopy device 1.

The localized plasmon resonance is a phenomenon in which an electric field is produced by vibration of free electrons in metal vibrate in resonance with the electric field of light. In particular, in a metal layer having a structure of very small protrusions and recesses, vibration of free electrons in the protrusions in resonance with the electric field of the light produces a strong electric field in the vicinities of the protrusions, and effectively excites localized plasmon resonance. According to the first embodiment, the first reflector 10 in the mass spectroscopy device 1 has a structure of protrusions and recesses which is finer than the wavelength of the measurement light L1, so that the localized plasmon resonance can be effectively excited.

Scattering and absorption of the measurement light L1 are greatly enhanced at the wavelength at which the localized plasmon resonance occurs (i.e., the resonance peak wavelength), so that the enhanced scattering and absorption of the measurement light L1, as well as the aforementioned resonance caused by the multiple interference, can increase the intensity of the electric field on the specimen-contact surface 1*s*. The resonance peak wavelength and the magnitudes of the scattering and the absorption of the measurement light L1 depend on the dimensions of the protrusions and recesses at the specimen-contact surface 1*s* of the mass spectroscopy device 1, the type of the metal, and the refractive index of the specimen arranged in contact with the specimen-contact surface 1*s* of the mass spectroscopy device 1, and other factors.

The absorption peak produced by the multiple interference and the absorption peak produced by the localized plasmon resonance may overlap or appear at different wavelengths. Even when the wavelength of the measurement light L1 is different from the above absorption peaks, the multiple interference and the localized plasmon resonance mutually enhance the effect (phenomenon) of intensifying the electric field produced by each other. It is possible to consider that an interaction between the two effects (phenomena) or a phenomenon unique to the mass spectroscopy device 1 may realize the mutual enhancement.

As explained above, the resonant wavelength $\lambda$ varies with the refractive index n and the thickness d of the transparent body 20. Therefore, it is possible to change the refractive index n and the thickness d of the transparent body 20 so as to maximize the synergy with the effect (phenomenon) of intensifying the electric field by the localized plasmon resonance.

Since the localized plasmon can be excited at least at the specimen-contact surface 1*s* (i.e., the upper surface of the first reflector 10), both of the localized plasmon resonance and the resonance caused by the multiple interference intensify the electric field on the specimen-contact surface 1*s* when the measurement light L1 contains a wavelength component which can excite the localized plasmon in the first reflector 10. Therefore, it is preferable that the measurement light L1 contain a wavelength component which can excite the localized plasmon in the first reflector 10. In addition, it is preferable that the first reflector 10 be formed of a metal which can realize the effect of intensifying the electric field by the localized plasmon resonance (although the first reflector 10 and the second reflector 30 may be formed of nonmetal reflective materials).

Furthermore, it is possible to apply to the specimen-contact surface 1*s* (i.e., the upper surface of the first reflector 10) surface modification R which can capture the analyte S. For example, when the analyte S is an antigen, the concentration of the analyte S on the specimen-contact surface 1*s* can be increased by surface decorating the specimen-contact surface 1*s* of the first reflector 10 with an antibody which can specifically combine with the antigen, so that the sensitivity can be increased.

It is preferable that the surface modification R be able to capture the analyte S, and the analyte S be readily desorbed from the specimen-contact surface 1*s* when the specimen-contact surface 1*s* is irradiated with the measurement light L1.

Figure 2B:
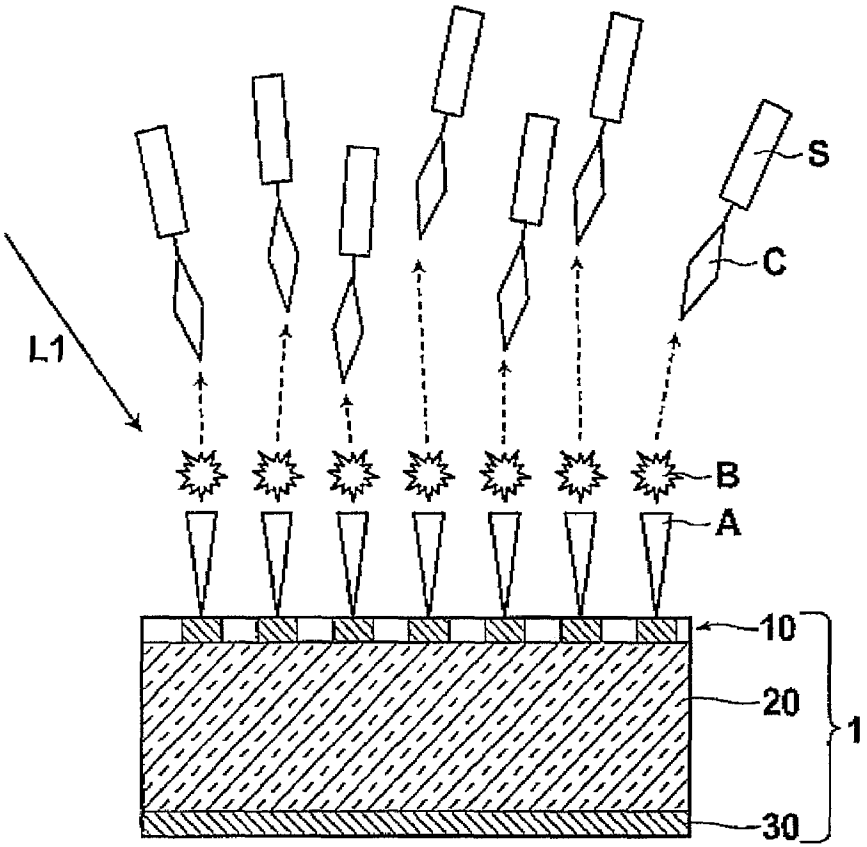
FIG. 2B is a diagram schematically illustrating an example of desorption of an analyte by irradiation with measurement light.
Figure 2A:
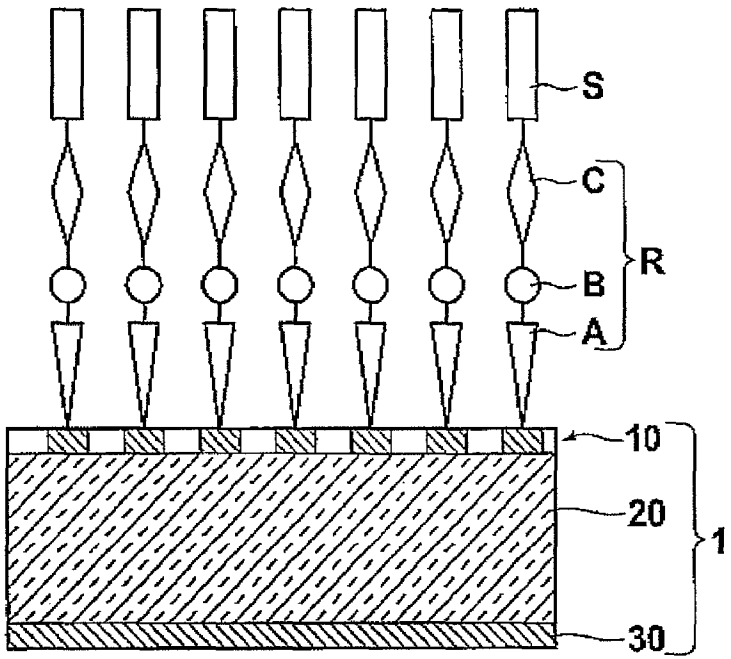
FIG. 2A is a diagram schematically illustrating an example of surface modification in the first embodiment.

FIG. 2A is a diagram schematically illustrating a preferable example of the surface modification R in the first embodiment. For clarification, the surface modification R and constituents of the surface modification R are magnified in FIG. 1. As illustrated in FIG. 2A, the surface modification R applied to the specimen-contact surface 1*s* is constituted by a first linker A, a second linker C, and a decomposer B. The first linker A is combined with the specimen-contact surface 1*s*, and the second linker C is combined with the analyte S. The decomposer B is interposed between the first linker A and the second linker C, and decomposed by an electric field generated by irradiation of the specimen-contact surface 1*s* with the measurement light L1. The surface modification R may be realized by a single material, or each of the first linker A, the second linker C, and decomposer B may be realized by a different material.

FIG. 2B is a diagram schematically illustrating desorption of the analyte S from the surface modification R illustrated in FIG. 2A by irradiation with the measurement light L1. When the mass spectroscopy device 1 surface modificated as illustrated in FIG. 2A is irradiated with the measurement light L1, the resonance caused by the multiple reflection in the optical resonator in the mass spectroscopy device 1 or both of the resonance caused by the multiple reflection and the localized plasmon resonance at the first reflector 10 occur, so that the electric field on the specimen-contact surface 1*s* is intensified. Therefore, the energy of the measurement light L1 is increased on the specimen-contact surface 1*s* by the intensified electric field, so that the increased energy decomposes the decomposer B in the surface modification R, and the analyte S combined with the second linker C is desorbed from the specimen-contact surface 1*s*. At this time, part of the decomposer B may be combined with the second linker C.

In the case where the specimen-contact surface 1*s* of the mass spectroscopy device 1 is surface modificated as illustrated in FIG. 2A, the analyte S is located at a certain distance from the specimen-contact surface 1*s*. When the energy of the measurement light L1 in the mass spectroscopy is high, the analyte S may not only be desorbed and may also be damaged by the irradiation with the measurement light L1, so that the mass spectroscopy may not be able to precisely performed. The mass spectroscopy device 1 uses the energy which is increased beyond the energy of the incident measurement light L1 by the effect of intensifying the electric field on the specimen-contact surface 1*s*. The effect of intensifying the electric field on the specimen-contact surface 1*s* is realized by optical absorption occurring inside the optical resonator or both of the optical absorption and the near-field light, so that the magnitude of the effect exponentially decreases with increase in the distance from the specimen-contact surface Is. Therefore, when the analyte S is relatively apart from the specimen-contact surface 1*s* as illustrated in FIG. 2A, optical energy which is sufficient to desorb the analyte S can be imparted to the decomposer B in such a manner that the analyte S per se is little affected by the increased optical energy. Therefore, in the case where the surface modification R as illustrated in FIG. 2A is applied to the first reflector 10 in the mass spectroscopy device 1, it is possible to reduce the damage to the analyte S, and perform highly precise mass spectroscopy.

Since the electric field on the specimen-contact surface Is of the mass spectroscopy device 1 is effectively intensified by the resonance realized by the multiple interference of the light multiply reflected between the first reflector 10 and the second reflector 30, the energy of the measurement light L1 on the specimen-contact surface Is can be increased by the intensified electric field, so that the irradiation energy of the incident measurement light L1 can be reduced, and the equipment cost can also be reduced. In addition, since the analyte S can be desorbed without using a material which can be desorbed concurrently with the analyte S and produce noise in mass spectroscopy, it is possible to improve the sensitivity in the mass spectroscopy. Thus, the mass spectroscopy device 1 according to the first embodiment enables reduction in the energy of the incident measurement light L1 and mass spectroscopy with high sensitivity.

Although the mass spectroscopy device 1 according to the first embodiment can desorb the analyte S without a material which produces noise, alternatively, the mass spectroscopy device 1 can also be used in the MALDI technique. As mentioned in the "Description of the Related Art," according to the MALDI technique, a specimen is prepared by mixing the analyte S in a matrix of sinapinic acid, glycerin, or the like, and is then irradiated with laser light so that the matrix absorbs the energy of the laser light and evaporates together with the analyte, and the analyte is ionized by proton transfer between the matrix and the analyte S.

Therefore, when the specimen which is arranged in contact with the specimen-contact surface 1*s* of the first reflector 10 in the mass spectroscopy device 1 contains a mixture of the analyte S and a matrix material, it is possible to desorb the analyte S and the matrix material from the specimen-contact surface 1*s* by irradiation with the measurement light L1, and ionize the analyte S and the matrix material.

The matrix material should be a material which can be easily ionized. For example, the matrix material for mass spectroscopy of a high-molecular-weight analyte may be sinapinic acid (3,5-dimethoxy-4-hydroxycinnamic acid) or CHCA (α-cyano-4-hydroxycinnamic acid), the matrix material for mass spectroscopy of a middle-to-high-molecular-weight analyte may be ferulic acid (trans-4-hydroxy-3-methoxycinnamic acid), the matrix material for mass spectroscopy of a low-to-middle-molecular-weight analyte may be gentisic acid (2,5-dihydroxy benzoic acid (DHBA)), and the matrix material for mass spectroscopy of a nucleic acid in negative ion mode may be HPA (3-hydroxy picolinic acid).

In the case where the mass spectroscopy device 1 is used in the MALDI technique, it is possible to use a low-energy light source in the MALDI technique. Therefore, the equipment cost and the measurement cost can be reduced. In addition, in the case where the mass spectroscopy device 1 is used in the mass spectroscopy using the MALDI technique, there is a possibility of realizing mass spectroscopy of materials which are so hard to evaporate or have so great molecular weight that mass spectroscopy of the materials are conventionally considered difficult.

Although the first reflector 10 is formed in a regular grid pattern, generally, the first reflector 10 may be formed in an arbitrary pattern (e.g., a random pattern). However, it is preferable that the regularity in the structure of the first reflector 10 be high, since the high regularity in the structure of the first reflector 10 increases the in-plane uniformity of the resonance structure and intensifies the characteristics of the mass spectroscopy device 1.

2. Second Embodiment

Figure 3A:
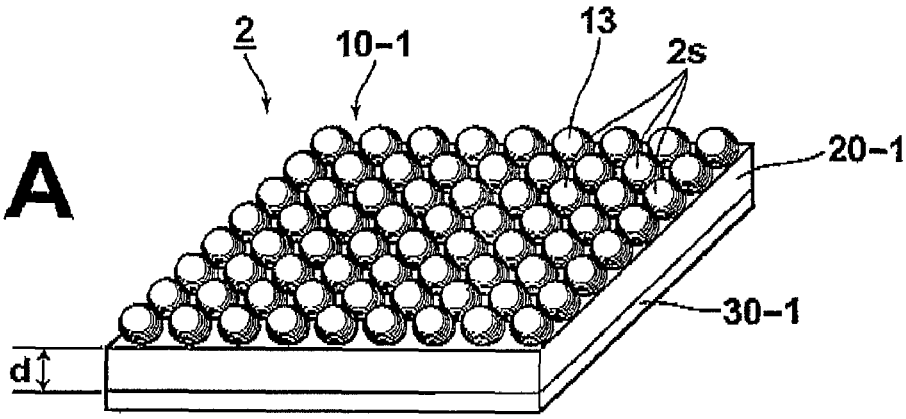
FIG. 3A is a perspective view of a mass spectroscopy device according to a second embodiment of the present invention.
Figure 3B:
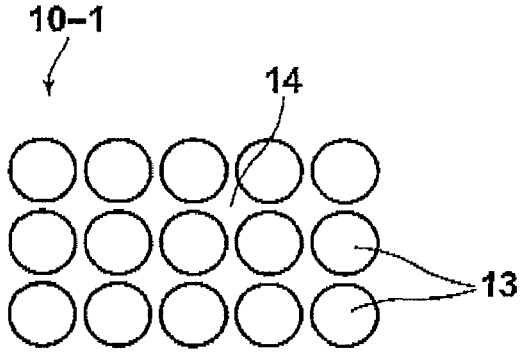
FIG. 3B is a partial top view of the mass spectroscopy device of FIG. 3A partially and schematically illustrating the arrangement of metal particles on a transparent body.

The mass spectroscopy device according to the second embodiment is explained below with reference to FIGS. 3A and 3B. FIG. 3A is a perspective view of the mass spectroscopy device according to the second embodiment, and FIG. 3B is a partial top view of the mass spectroscopy device of FIG. 3A, which partially and schematically illustrates the arrangement of metal particles on a transparent body. In the following explanations on the second embodiment, descriptions of elements or constituents equivalent to the first embodiment are not repeated unless necessary.

As illustrated in FIGS. 3A and 3B, the mass spectroscopy device 2 according to the second embodiment has a structure constituted by a first reflector 10-1, a transparent body 20-1, and a second reflector 30-1. The first reflector 10-1 is arranged on the light-injection side (the upper side in FIG. 3A) of the transparent body 20-1, and the second reflector 30-1 is arranged on the opposite side of the transparent body 20-1. The first reflector 10-1 is partially transparent and partially reflective, and the second reflector 30-1 is reflective. The (upper) surface of the first reflector 10-1 is a specimen-contact surface 2*s* of the mass spectroscopy device 2, with which a specimen is to be arranged in contact. Measurement light L1 is applied from the light-injection side (the upper side in FIG. 3A) of the mass spectroscopy device 2.

The second embodiment is different from the first embodiment in that the first reflector 10-1 is realized by a metal layer which is realized by a plurality of noncohesive metal particles 13 having approximately identical diameters, and the noncohesive metal particles 13 are regularly arrayed in a matrix arrangement on a surface of the transparent body 20-1 and fixed to the surface, while the metal wires 11 are arranged in a grid pattern in the first embodiment. The transparent body 20-1 and the second reflector 30-1 in the second embodiment are similar to the transparent body 20 and the second reflector 30 in the first embodiment.

Similar to the mass spectroscopy device 1 according to the first embodiment, in the mass spectroscopy device 2 according to the second embodiment, it is also preferable that the regularity in the structure of the first reflector 10-1 be high, since the high regularity in the structure of the first reflector 10-1 increases the in-plane uniformity of the resonance structure and intensifies the characteristics of the mass spectroscopy device 2. If the metal particles 13 contain cohesive metal particles, the first reflector 10-1 can contain first part in which a number of metal particles cohere and second part in which metal particles do not cohere, so that the regularity in the structure of the first reflector 10-1 is likely to be lowered. However, since the first reflector 10-1 is formed with the noncohesive metal particles 13, it is possible to easily form the first reflector 10-1, and the regularity in the first reflector 10-1 is higher than the regularity in the first reflector where the metal particles 13 contain cohesive metal particles.

The material of the metal particles 13 is not specifically limited, and may be any of the examples of the material of the metal wires 11 mentioned before.

In addition, as explained in the "SUMMARY OF THE INVENTION," the noncohesive metal particles 13 may include metal particles which do not gather (i.e., metal particles which are separated from each other), and metal particles separated into groups each of which metal particles are irreversibly and integrally combined.

In the case where the noncohesive metal particles 13 do not gather, the noncohesive metal particles 13 may be separated from each other by at least a predetermined distance. In this case, the metal particles 13 may be arranged either randomly or approximately regularly.

An example of the first reflector 10-1 in which the metal particles 13 are randomly arranged is a metal layer formed in an island pattern (which can be formed by oblique-incidence evaporation or the like), and an example of the first reflector 10-1 in which the metal particles 13 are approximately regularly arranged is a metal layer formed in a dot pattern, a mesh pattern, a bow-tie array pattern, or the like. Further, needle-like metal particles 13 may be arranged in an approximately regular pattern. In these cases, the patterning can be realized by processing using lithography, a focused ion beam (FIB) technique, or the like, or a technique utilizing self-organization.

On the other hand, the first reflector 10-1 in which the metal particles 13 are separated into groups in each of which metal particles are integrally and irreversibly combined can be produced, for example, in a process of metal growth by fusion or plating.

Further, the first reflector 10-1 can also be formed by applying a dispersion solution of the metal particles 13 to the upper surface of the transparent body 20-1 by spin coating or the like, and drying the applied dispersion solution. In this case, it is preferable that the dispersion solution contain a binder such as resin or protein so that the metal particles 13 are fixed to the surface of the transparent body 20-1 through the binder. In the case where the binder is protein, the metal particles 13 can be fixed to the surface of the transparent body 20-1 by utilizing binding reaction between protein molecules.

Since the first reflector 10-1 is formed of reflective metal and has gaps 14 between the metal particles 13, the first reflector 10-1 is partially transparent and partially reflective. The diameters of and the pitch between the metal particles 13 are designed to be smaller than the wavelength of the measurement light L1, so that the first reflector 10-1 has a structure of protrusions and recesses which is finer than the wavelength of the measurement light L1. Therefore, the first reflector 10-1 is a thin film having a mesh electromagnetic shield effect as well as the partially transparent and partially reflective characteristics.

In the mass spectroscopy device 2, the electric field on the specimen-contact surface 2*s* (i.e., the upper surface of the first reflector 10-1) is intensified when the mass spectroscopy device 2 is irradiated with the measurement light L1, and the energy of the measurement light L1 is increased on the specimen-contact surface 2*s*, so that the increased energy enables desorption of the analyte S from the specimen-contact surface 2*s*. Thus, mass spectroscopy of the analyte S is enabled.

The pitch between the metal particles 13 is not specifically limited as long as the pitch is smaller than the wavelength of the measurement light L1. However, generally, it is more preferable that the metal particles 13 be arranged with a smaller pitch. For example, it is preferable that the pitch between the metal particles 13 not exceed 200 nm in the case where the measurement light L1 is visible light.

Although the diameters of the metal particles 13 are not specifically limited, generally, it is more preferable that the metal particles 13 have smaller diameters. Specifically, it is preferable that the diameters of the metal particles 13 not exceed the mean free path of the electrons which vibrate in metal by the action of the light. The diameters of the metal particles 13 are preferably equal to or smaller than 50 nm, and more preferably equal to or smaller than 30 nm.

Similar to the mass spectroscopy device 1 according to the first embodiment, when the measurement light L1 is injected onto the mass spectroscopy device 2 according to the second embodiment, part of the measurement light L1 passes through the first reflector 10-1, enters the transparent body 20-1, and is multiply reflected between the first reflector 10-1 and the second reflector 30-1, so that the multiply reflected light effectively causes multiple interference and resonance at a specific wavelength satisfying a resonant condition. The resonance absorbs the light at the resonant wavelength, and intensifies the electric field in the mass spectroscopy device 2. That is, the effect of intensifying the electric field on the specimen-contact surface 2*s* works. As in the mass spectroscopy device 1 according to the first embodiment, the resonant wavelength in the mass spectroscopy device 2 also varies with the average refractive index and the thickness of the transparent body 20-1. Therefore, it is possible to achieve the effect of highly intensifying the electric field at the resonant wavelength (e.g., by the factor of 100 or more).

Since the mass spectroscopy device 2 according to the second embodiment is basically similar to the mass spectroscopy device 1 according to the first embodiment except that the first reflector 10-1 is realized by the layer of the metal particles 13, the mass spectroscopy device 2 has similar advantages to the mass spectroscopy device 1. Therefore, even in the mass spectroscopy device 2, it is possible to achieve mass spectroscopy with high precision when surface modification similar to the surface modification R in the first embodiment as illustrated in FIG. 2A is applied to the upper surface of the first reflector 10-1.

Although the metal particles 13 having approximately identical diameters are approximately regularly arranged in a matrix and fixed to the transparent body 20-1 in the mass spectroscopy device 2 explained above, alternatively, the diameters of the metal particles 13 may vary and have a distribution, and the metal particles 13 may be arranged in an arbitrary pattern or randomly arranged.

3. Third Embodiment

Figure 4:
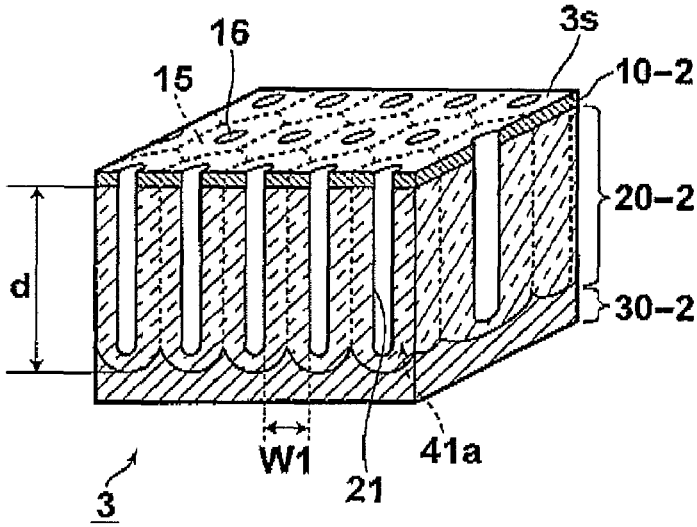
FIG. 4 is a perspective view of a mass spectroscopy device according to a third embodiment of the present invention.
Figure 5A:
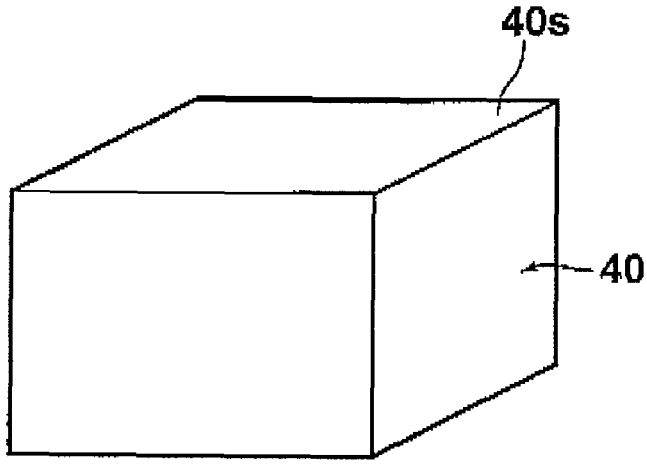
FIGS. 5A, 5B, and 5C are perspective views of the structures in respective stages in a process for producing the mass spectroscopy device of FIG. 4.
Figure 5B:
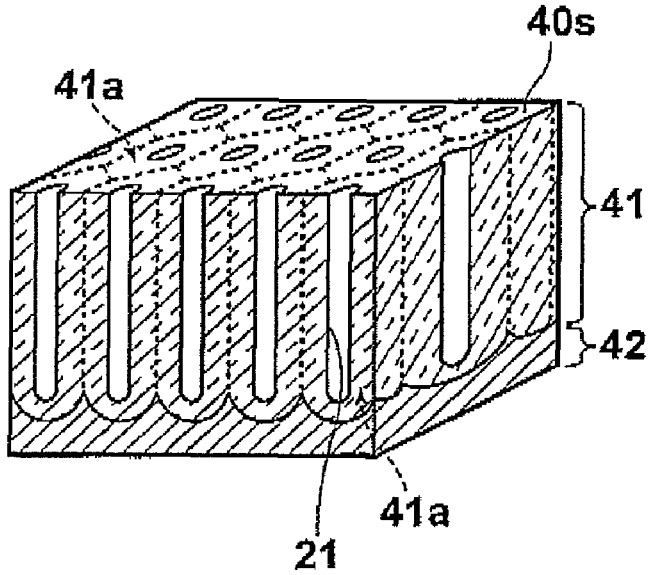
Figure 5C:
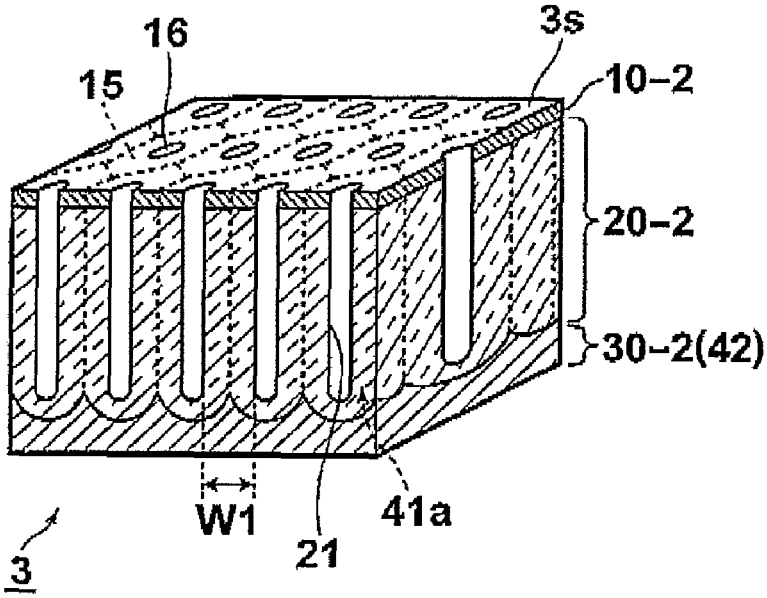

The mass spectroscopy device according to the third embodiment is explained below with reference to FIGS. 4, 5A, 5B, and 5C. FIG. 4 is a perspective view of the mass spectroscopy device according to the third embodiment, and FIGS. 5A, 5B, and 5C are perspective views of the structures in respective stages in a process for producing the mass spectroscopy device of FIG. 4. In the following explanations on the third embodiment, descriptions of elements or constituents equivalent to the first or second embodiment are not repeated unless necessary.

As illustrated in FIG. 4, the mass spectroscopy device 3 according to the third embodiment has a structure constituted by a first reflector 10-2, a transparent body 20-2, and a second reflector 30-2. The first reflector 10-2 is arranged on the light-injection side (the upper side in FIG. 4) of the transparent body 20-2, and the second reflector 30-2 is arranged on the opposite side of the transparent body 20-2. The first reflector 10-2 is partially transparent and partially reflective, and the second reflector 30-2 is reflective. The (upper) surface of the first reflector 10-2 is a specimen-contact surface 3*s* of the mass spectroscopy device 3, with which a specimen is to be arranged in contact. Measurement light L1 is applied from the light-injection side (the upper side in FIG. 4) of the mass spectroscopy device 3.

The mass spectroscopy device 3 according to the third embodiment is different from the first embodiment in that the transparent body 20-2 is formed of metal oxide (e.g., $Al_2O_3$) 41 which is obtained by anodic oxidation of a portion of a base body 40 of metal (e.g., aluminum) as illustrated in FIGS. 5A and 5B, and the second reflector 30-2 is realized by the unoxidized portion 42 of the base body 40 as illustrated in FIGS. 5B and 5C. Thus, the second reflector 30-2 is reflective.

The transparent body 20-2 is a transparent microporous body as illustrated in FIG. 5B. The transparent microporous body has a plurality of micropores 21 approximately straightly extending from the end on the first-reflector side (the upper end of the transparent body 20-2 in FIG. 4) toward the opposite end on the second-reflector side (the lower end of the transparent body 20-2 in FIG. 4). The micropores 21 are open at the ends on the first-reflector side, and closed on the second-reflector side. The micropores 21 have diameters smaller than the wavelength of the measurement light L1, and are approximately regularly arranged with an array pitch smaller than the wavelength of the measurement light L1.

The anodic oxidation can be performed by immersing the metal base body 40 (which is to be anodically oxidized) and a cathode in an electrolyte, and applying a voltage between the cathode and the metal base body 40 (which behaves as an anode). Although the shape of the metal base body 40 is not specifically limited, it is preferable that the metal base body 40 have a plate-like shape or the like. Alternatively, the metal base body 40 may be formed as a layer on a support, and can be used together with the support. The cathode may be made of carbon, aluminum, or the like. Although the electrolyte is not specifically limited, it is preferable that the electrolyte be an acidic electrolyte containing one or more of sulfuric acid, phosphoric acid, chromic acid, oxalic acid, sulfamic acid, benzenesulfonic acid, and the like.

As illustrated in FIGS. 5A, 5B, and 5C, when the metal base body 40 is anodically oxidized, the oxidation reaction proceeds from a surface 40*s* (the upper surface in FIG. 5A) of the metal base body 40 along a direction approximately perpendicular to the surface 40*s*, and the portion 41 of the metal base body 40 is transformed into metal oxide (e.g., $Al_2O_3$). The portion 41 of metal oxide has a structure having a great number of hexagonal microprisms 41*a*, where the horizontal cross sections of the hexagonal microprisms 41*a* are approximately equilateral hexagons, and the hexagonal microprisms 41*a* are closely arrayed. In addition, the aforementioned plurality of micropores 21 (approximately straightly extending along the depth direction) are respectively produced approximately in the centers of the hexagonal microprisms 41*a*, and each of the hexagonal microprisms 41*a* has a round bottom end. The structure of the metal oxide produced by anodic oxidation are indicated by H. Masuda, "Preparation of Mesoporous Alumina by Anodic Oxidation and Application of Mesoporous Alumina as Functional Material," Material Technology, Vol. 15, No. 10, p. 34, 1997.

A preferable example of a condition for anodic oxidation in production of the regularly arrayed structure of the metal oxide 41 is indicated below.

In the case where oxalic acid is used as the electrolyte, for example, the condition is that the concentration of the electrolyte is 0.5 mol/L, the liquid temperature is 14 to 16° C., and the applied voltage is 40 to 40±0.5 V. It is normally possible to control the pitch between the micropores 21 in the range of 10 to 500 nm and the diameters of the micropores 21 in the range of 5 to 400 nm. U.S. Pat. Nos. 6,476,409, 6,784,007, 6,610,463 and 6,924,023 disclose techniques for relatively finely controlling the positions and the diameters of micropores. It is possible to approximately regularly form the micropores having arbitrary diameters and depths in the above ranges of the diameters and the pitch. The micropores 21 formed under the above condition have, for example, the diameters of 5 to 200 nm and the pitch of 10 to 400 nm.

In the third embodiment, the first reflector 10-2 is formed by metal evaporation or the like on the transparent body 20-2, and realized by a metal layer formed along the upper surface of the transparent body 20-2. Since the metal layer is formed on the hexagonal microprisms 41*a*, and is not formed on the micropores 21, the first reflector 10-2 is constituted by a plurality of metal microbodies 15 respectively formed on the hexagonal microprisms 41*a*, the plurality of metal microbodies 15 of the first reflector 10-2 are closely arranged on the transparent body 20-2, and each of the metal microbodies 15 has an equilaterally hexagonal cross-sectional shape and a microhole 16 approximately in the center of the metal microbody. Since the plurality of microholes 16 in the first reflector 10-2 are formed in a pattern corresponding to the pattern in which the micropores 21 in the hexagonal microprisms 41*a* are formed, the microholes 16 are approximately regularly arranged with diameters and a pitch which are smaller than the wavelength of the measurement light L1. When the metal layer of the first reflector 10-2 is formed by evaporation, the metal may be deposited on the bottoms of the micropores 21.

Since the first reflector 10-2 is formed of reflective metal, and the first reflector 10-2 has the plurality of microholes 16, the first reflector 10-2 is partially transparent and partially reflective. Since the metal microbodies 15 (being regularly arranged on the transparent body 20-2 and respectively having the microholes 16 at approximately the centers of the metal microbodies) have dimensions smaller than the wavelength of the measurement light L1, a structure of protrusions and recesses which is finer than the wavelength of the measurement light L1 is realized in the first reflector 10-2. Therefore, the first reflector 10-2 is a thin film exhibiting a mesh electromagnetic shield effect as well as the partially transparent and partially reflective characteristics.

Similar to the mass spectroscopy devices 1 and 2 according to the first and second embodiments, the electric field on the specimen-contact surface 3*s* (i.e., the upper surface of the first reflector 10-2) in the mass spectroscopy device 3 is intensified when the mass spectroscopy device 3 is irradiated with the measurement light L1, and the energy of the measurement light L1 is increased on the specimen-contact surface 3*s*, so that the increased energy enables desorption of the analyte S from the specimen-contact surface 3*s*. Thus, mass spectroscopy of the analyte S is enabled.

The pitch between the metal microbodies 15 and the pitch between the microholes 16 are not specifically limited as long as the pitches are smaller than the wavelength of the measurement light L1. However, generally, it is more preferable that the pitch between the metal microbodies 15 and the pitch between the microholes 16 be smaller. For example, it is preferable that the pitch between the metal microbodies 15 and the pitch between the microholes 16 not exceed 200 nm in the case where the measurement light L1 is visible light.

Although the distances between adjacent ones of the microholes 16 (i.e., the widths W1 of the metal microbodies existing between adjacent ones of the microholes 16) are not specifically limited, generally, it is more preferable that the distances be smaller. The widths W1 correspond to the width of the metal wires 11 in the first embodiment and the diameters of the metal particles 13 in the second embodiment. Specifically, it is preferable that the widths W1 not exceed the mean free path of the electrons which vibrate in metal by the action of the light. The widths W1 are preferably equal to or smaller than 50 nm, and more preferably equal to or smaller than 30 nm.

In contrast to the first and second embodiments, the second reflector 30-2 in the mass spectroscopy device 3 according to the third embodiment is realized by the unoxidized portion 42 of the base body 40 (which is made of, for example, aluminum) as illustrated in FIGS. 5B and 5C. That is, the second reflector 30-2 has a structure of protrusions and recesses on the upper side. Therefore, it is possible to cause localized plasmon resonance in the second reflector 30-2 as well as the first reflector 10-2.

In the mass spectroscopy device 3, the bottom portions of the micropores 21 may be filled with metal, and the filler metal may be evaporated on and fixed to the bottom surfaces of the micropores 21. In this case, since the bottom portions of the micropores 21 filled with the filler metal are approximately regularly arranged in the hexagonal microprisms 41*a* of the transparent metal oxide, the localized plasmon resonance can more effectively occur inside the mass spectroscopy device 3, so that the effect of intensifying the electric field can be highly enhanced at the wavelength at which the localized plasmon resonance occurs.

Although the filler metal with which the bottom portions of the micropores 21 are filled is not specifically limited, the filler metal is preferably gold (Au), silver (Ag), copper (Cu), nickel (Ni), titanium (Ti), or the like, and gold or silver is particularly preferable. In this case, since the localized plasmon resonance occurs at the specimen-contact surface 3*s* and the bottom portions of the micropores 21, in order to make the localized plasmon resonance more effective, it is preferable that the filler metal with which the bottom portions of the micropores 21 are filled be identical to the metal of which the first reflector 10-2 is formed.

Similar to the mass spectroscopy devices 1 and 2 according to the first and second embodiments, in the mass spectroscopy device 3 according to the third embodiment, part of the measurement light L1 passes through the first reflector 10-2, enters the transparent body 20-2, and is multiply reflected between the first reflector 10-2 and the second reflector 30-2, so that the multiply reflected light effectively causes multiple interference and resonance at a specific wavelength satisfying a resonant condition. The resonance absorbs the light at the resonant wavelength, and intensifies the electric field in the mass spectroscopy device 3. That is, the effect of intensifying the electric field on the specimen-contact surface 3*s* works. As in the mass spectroscopy device 1 according to the first embodiment, the resonant wavelength in the mass spectroscopy device 3 also varies with the average refractive index and the thickness of the transparent body 20-2. Therefore, it is possible to achieve the effect of highly intensifying the electric field at the resonant wavelength (e.g., by the factor of 100 or more).

Since the localized plasmon resonance effectively occurs in the bottom portions of the micropores 21 in the mass spectroscopy device 3 according to the third embodiment, the electric field is intensified by the localized plasmon resonance more highly in the mass spectroscopy device 3 than in the mass spectroscopy devices 1 and 2 (according to the first and second embodiments).

The mass spectroscopy device 3 according to the third embodiment is similar to the mass spectroscopy device 1 according to the first embodiment in the basic structure except that the transparent body 20-2 is a transparent microporous body having the plurality of micropores 21 which are open at the ends on the first-reflector side, and the first reflector 10-2 is the metal layer having the plurality of microholes 16 in correspondence with the surface profile of the transparent body 20-2. Therefore, the mass spectroscopy device 3 has similar advantages to the mass spectroscopy device 1 according to the first embodiment, and the mass spectroscopy device 3 also enables highly precise mass spectroscopy when surface modification similar to the surface modification R in the first embodiment illustrated in FIG. 2A is applied to the surface of the first reflector 10-2.

Since the mass spectroscopy device 3 according to the third embodiment is produced by using anodic oxidation, it is possible to easily manufacture the mass spectroscopy device 3, in which the micropores 21 in the transparent body 20-2 and the microholes 16 in the first reflector 10-2 are approximately regularly arranged (although the micropores 21 in the transparent body 20-2 and the microholes 16 in the first reflector 10-2 may be randomly arranged). Therefore, the mass spectroscopy device 3 is advantageous.

Although only the bottom portions of the micropores 21 are filled with the metal in the mass spectroscopy device 3 described above, generally, it is possible to fill the entire or partial spaces in the micropores 21 with metal. In the case where the entire spaces of the micropores 21 are filled with metal, and the first reflector 10-2 has such a thickness that light can pass through the first reflector 10-2, an optical resonator can be realized in the mass spectroscopy device 3, and the optical resonance can occur in the mass spectroscopy device 3. Therefore, even in this case, the optical resonance and the localized plasmon resonance can mutually enhance the effect of intensifying the electric field produced by each other. That is, the electric field can be intensified by the localized plasmon resonance, which effectively occurs in this case.

The main component of the metal body 40 (from which the transparent body 20-2 and the second reflector 30-2 are produced) is not limited to aluminum, and may be any metal as long as the oxide of the metal produced by anodic oxidation is transparent. For example, the metal body 40 may be made of titanium (Ti), tantalum (Ta), hafnium (Hf), zirconium (Zr), silicon (Si), indium (In), zinc (Zn), or the like. In addition, the metal body 40 may be made of two or more types of metals which can be anodically oxidized.

4. Fourth Embodiment

Figure 6:
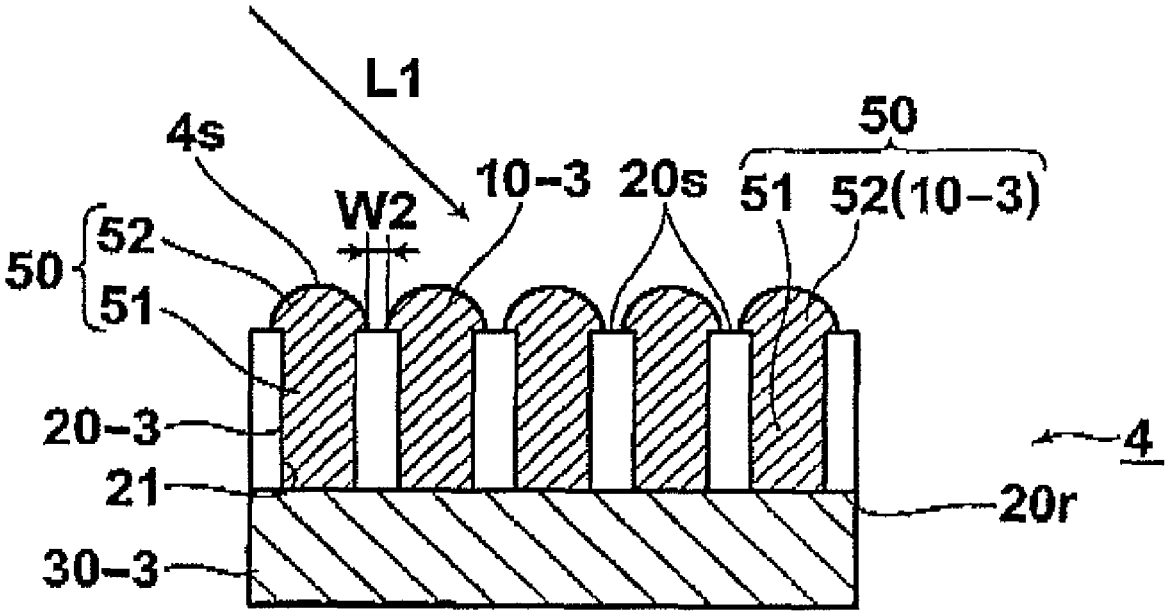
FIG. 6 is a cross-sectional view illustrating a cross section of a mass spectroscopy device according to a fourth embodiment along the thickness direction.
Figure 7A:
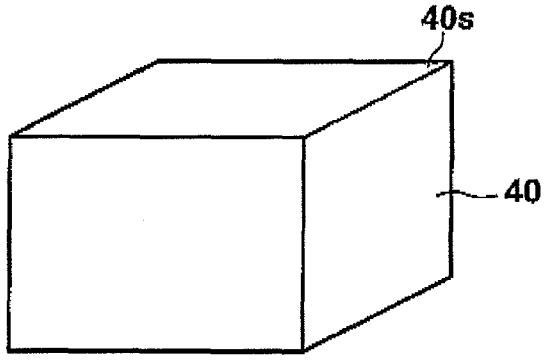
FIGS. 7A, 7B, and 7C are perspective views of the structures in respective stages in a process for producing the mass spectroscopy device of FIG. 6.
Figure 7B:
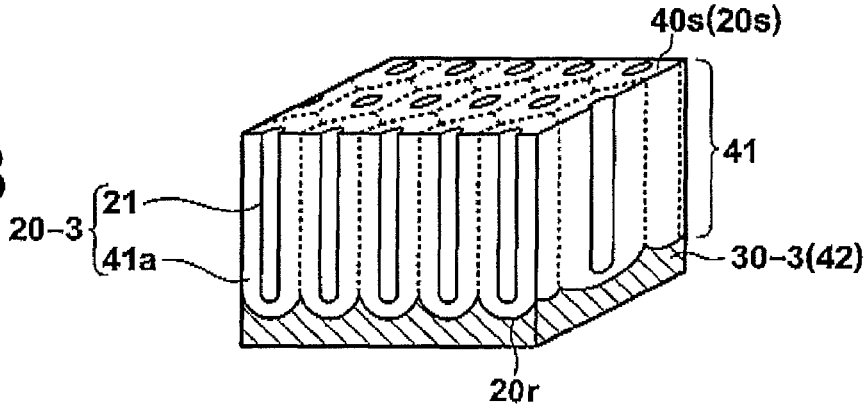
Figure 7C:
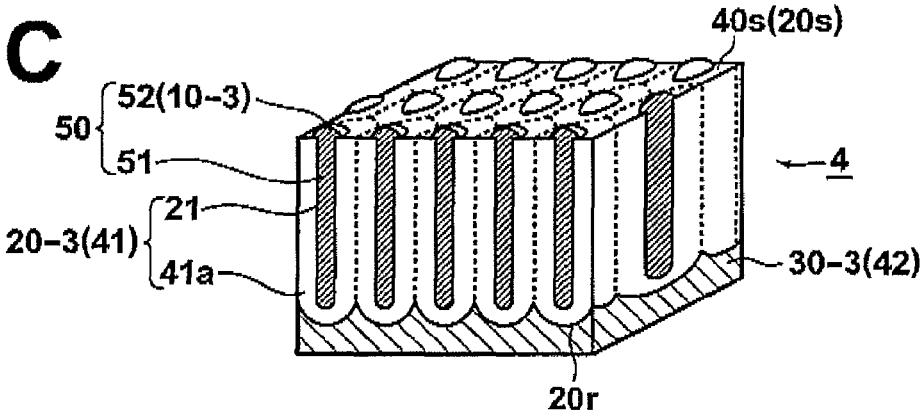
Figure 8A:
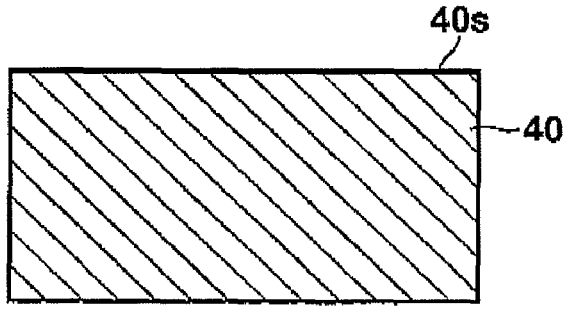
FIGS. 8A, 8B, and 8C are cross-sectional views of the structures in the stages of FIGS. 7A, 7B, and 7C, respectively.
Figure 8B:
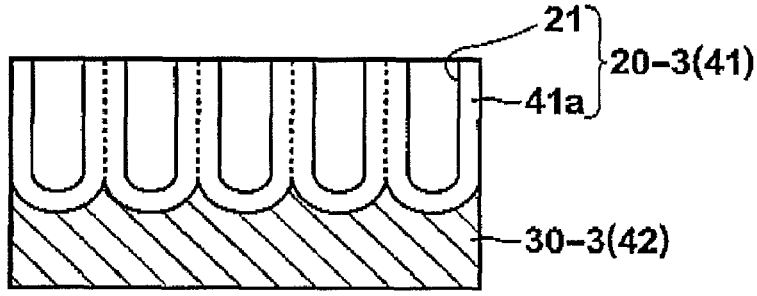
Figure 8C:
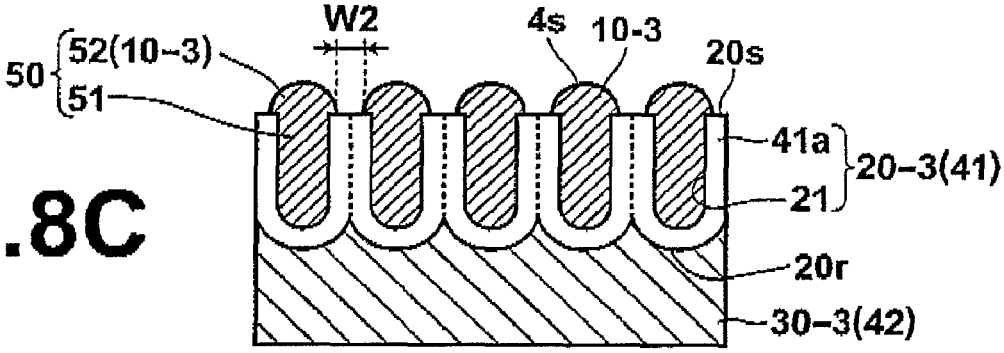

The mass spectroscopy device according to the fourth embodiment is explained below with reference to FIGS. 6, 7A, 7B, 7C, 8A, 8B, and 8C. FIG. 6 is a cross-sectional view illustrating a cross section, along the thickness direction, of the mass spectroscopy device according to the fourth embodiment. FIGS. 7A, 7B, and 7C are perspective views of the structures in respective stages in a process for producing the mass spectroscopy device of FIG. 6. FIGS. 8A, 8B, and 8C are cross-sectional views of the structures in the stages of FIGS. 7A, 7B, and 7C, respectively. In FIGS. 6, 7A, 7B, 7C, 8A, 8B, and 8C, elements and constituents equivalent to the corresponding elements or constituents in the first and third embodiments are indicated by the same reference numbers as the first or third embodiment, and descriptions of the equivalent elements or constituents are not repeated in the following explanations unless necessary.

As illustrated in FIG. 6, the mass spectroscopy device 4 according to the fourth embodiment has a structure constituted by a first reflector 10-3, a transparent body 20-3, and a second reflector 30-3. The first reflector 10-3 is arranged on the light-injection side (the upper side in FIG. 6) of the transparent body 20-3, and the second reflector 30-3 is arranged on the opposite side of the transparent body 20-3. The first reflector 10-3 is partially transparent and partially reflective, and the second reflector 30-3 is reflective. The (upper) surface of the first reflector 10-3 is a specimen-contact surface 4*s* of the mass spectroscopy device 4, with which a specimen is to be arranged in contact.

The transparent body 20-3 is formed of metal oxide (e.g., $Al_2O_3$) 41 which is obtained by anodic oxidation of a portion of a base body 40 of metal (e.g., aluminum) as illustrated in FIGS. 6, 7B, and 8B, and the second reflector 30-3 is realized by the unoxidized portion 42 of the base body 40 as illustrated in FIGS. 6, 7B, 7C, 8B and 8C. Thus, the second reflector 30-3 is reflective. The mass spectroscopy device 4 according to the fourth embodiment has a structure similar to the mass spectroscopy device 3 according to the third embodiment except that the first reflector 10-3 in the mass spectroscopy device 4 has a structure different from the first reflector 10-2 in the mass spectroscopy device 3.

The mass spectroscopy device 4 has a plurality of metal microbodies 50, and each of the metal microbodies 50 includes a metal-filler portion 51 and a metal protrusion 52. The micropores 21 are filled with the metal-filler portions 51, and the metal protrusions 52 are formed so as to protrude above the upper surface 20*s* of the transparent body 20-3 and have diameters greater than the diameters of the metal-filler portions 51. The metal protrusions 52 realize the first reflector 10-3, and the surfaces of the metal protrusions 52 realize the specimen-contact surface 4*s* of the mass spectroscopy device 4.

The metal microbodies 50 constituted by the metal-filler portions 51 and the metal protrusions 52 can be produced by electroplating or the like of the micropores 21.

In the electroplating, the second reflector 30-3 behaves as an electrode, and metal is preferentially deposited on the bottom potions of the micropores 21 since the electric field during the electroplating is strongest in the bottom potions of the micropores 21. The micropores 21 can be filled with the metal by continuing the electroplating, so that the metal-filler portions 51 are produced. When the electroplating is further continued after the micropores 21 are filled with the metal, the deposited metal protrudes above the upper surface 20*s*. Since the electric field around the micropores 21 is strong during the electroplating, the metal is continuously deposited around the upper ends of the micropores 21, so that the metal protrusions 52 having the greater diameters than the metal-filler portions 51 are formed as illustrated in FIGS. 6, 7C, and 8C.

In some cases, during the electroplating for producing the metal microbodies 50, the portions of the anodically oxidized metal 41 (i.e., the transparent body 20-2) located between the bottoms of the micropores 21 and the bottom end 20*r* of the anodically oxidized metal 41 may be broken so that the metal deposited by the electroplating may reach the unoxidized portion 42 (the second reflector 30-2).

There are gaps between the metal protrusions 52 at the upper surface 20*s* of the transparent body 20-3 although the plurality of metal microbodies 50 are arranged near to each other. Therefore, the first reflector 10 is partially transparent and partially reflective. Similar to the third embodiment, it is normally possible to control the pitch between the micropores 21 in the range of 10 to 500 nm and the diameters of the micropores 21 in the range of 5 to 400 nm. Since the first reflector 10-3 is realized by the metal protrusions 52 respectively located over the metal-filler portions 51 with which the micropores 21 are filled, the first reflector 10-3 has a structure of protrusions and recesses which is finer than the wavelength of the measurement light L1. Therefore, the first reflector 10-3 is a thin film exhibiting a mesh electromagnetic shield effect as well as the partially transparent and partially reflective characteristics.

Similar to the mass spectroscopy devices 1, 2, and 3 according to the first, second, and third embodiments, the electric field on the specimen-contact surface 4*s* (i.e., the upper surface of the first reflector 10-3) in the mass spectroscopy device 4 is intensified when the mass spectroscopy device 4 is irradiated with the measurement light L1, and the energy of the measurement light L1 is increased on the specimen-contact surface 4*s*, so that the increased energy enables desorption of the analyte S from the specimen-contact surface 4*s*. Thus, mass spectroscopy of the analyte S is enabled.

In the mass spectroscopy device 4 according to the fourth embodiment, the metal protrusions 52 produce a grainy profile at the specimen-contact surface 4*s*, so that a structure of protrusions and recesses is realized at the specimen-contact surface 4*s*. It is possible to regard that the metal protrusions 52 substantially realize a layer of metal particles on the upper surface 20*s* of the transparent body 20-3. Since the structure of protrusions and recesses is preferably finer than the wavelength of the measurement light L1, the diameters of and the pitch between the metal protrusions 52 are preferably smaller than the wavelength of the measurement light L1. It is preferable that the metal protrusions 52 have such dimensions that localized plasmon resonance can be excited in the metal protrusions 52, since the electric field on the specimen-contact surface 4*s* can be intensified by the localized plasmon resonance in this case. In consideration of the wavelength of the measurement light L1, it is preferable that the diameters of the metal protrusions 52 be in the range of 10 to 300 nm.

In addition, it is preferable that adjacent ones of the metal protrusions 52 be separated, and the average W2 of the distances by which the adjacent ones of the metal protrusions 52 are separated be several to ten nanometers. In this case, the electric field on the specimen-contact surface 4*s* can be effectively intensified by localized plasmon resonance.

The material of the metal microbodies 50 is not specifically limited, and may be any of the examples which are mentioned before as the material of the first reflector 10 in the first embodiment.

Similar to the mass spectroscopy devices 1, 2, and 3 according to the first, second, and third embodiments, in the mass spectroscopy device 4 according to the fourth embodiment, part of the measurement light L1 passes through the first reflector 10-3, enters the transparent body 20-3, and is multiply reflected between the first reflector 10-3 and the second reflector 30-3, so that the multiply reflected light effectively causes multiple interference and resonance at a specific wavelength satisfying a resonant condition. The resonance absorbs the light at the resonant wavelength, and intensifies the electric field in the mass spectroscopy device 4. That is, the effect of intensifying the electric field on the specimen-contact surface 4*s* works. As in the mass spectroscopy device 1 according to the first embodiment, the resonant wavelength in the mass spectroscopy device 4 also varies with the average refractive index and the thickness of the transparent body 20-3. Therefore, it is possible to achieve the effect of highly intensifying the electric field at the resonant wavelength (e.g., by the factor of 100 or more).

Since the mass spectroscopy device 4 according to the fourth embodiment is basically similar to the mass spectroscopy device 1 according to the first embodiment except that the transparent body 20-3 is realized by a transparent microporous body having the plurality of micropores 21 which are open at the ends on the first-reflector side, the micropores 21 are filled with the metal-filler portions 51, and the first reflector 10-3 is constituted by the plurality of metal protrusions 52 which protrude above the upper surface 20*s* of the transparent body 20-3 and have the diameters greater than the diameters of the micropores 21. Therefore, the mass spectroscopy device 4 has similar advantages to the mass spectroscopy device 1 according to the first embodiment, and the mass spectroscopy device 4 also enables highly precise mass spectroscopy when surface modification similar to the surface modification R in the first embodiment illustrated in FIG. 2A is applied to the surface of the first reflector 10-3.

Since the mass spectroscopy device 4 according to the fourth embodiment is produced by using anodic oxidation, it is possible to easily manufacture the mass spectroscopy device 4, in which the micropores 21 in the transparent body 20-3 and the metal protrusions 52 in the first reflector 10-3 are approximately regularly arranged (although the micropores 21 in the transparent body 20-2 and the metal protrusions 52 in the first reflector 10-3 may be randomly arranged). Therefore, the mass spectroscopy device 4 is advantageous.

The main component of the metal body 40 (from which the transparent body 20-3 and the second reflector 30-3 are produced) is not limited to aluminum, and may be any metal as long as the oxide of the metal produced by anodic oxidation is transparent. For example, the metal body 40 may be made of titanium (Ti), tantalum (Ta), hafnium (Hf), zirconium (Zr), silicon (Si), indium (In), zinc (Zn), or the like. In addition, the metal body 40 may be made of two or more types of metals which can be anodically oxidized.

In the third and fourth embodiments, the transparent body 20-2 or 20-3 (in which the micropores 21 are approximately regularly arranged) is produced by using the anodic oxidation. The use of the anodic oxidation is advantageous since the anodic oxidation enables the concurrent processing of the entire surface, can cope with increase in the surface area, and does not require use of expensive equipment. However, the manner of production of the micropores 21 is not limited to the anodic oxidation. For example, a plurality of regularly arranged recesses can be formed on the surface of a transparent body by using the nanoprint technology or micromachining technology. In the micromachining technology, the regularly arranged recesses can be drawn by a beam drawing technique such as the focused ion beam (FIB) technique or the electron beam (EB) technique.

5. Fifth Embodiment

Figure 9:
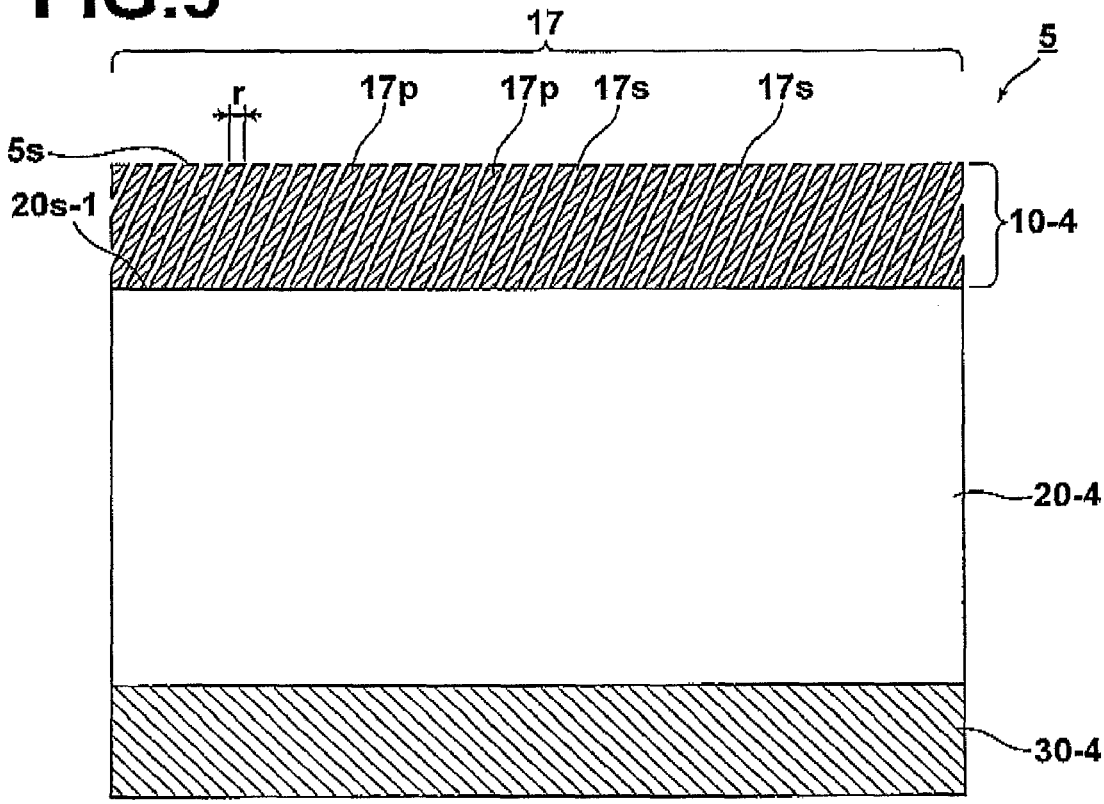
FIG. 9 is a cross-sectional view illustrating a cross section, along the thickness direction, of a mass spectroscopy device according to a fifth embodiment.

The mass spectroscopy device according to the fifth embodiment is explained below with reference to FIG. 9. FIG. 9 is a cross-sectional view illustrating a cross section, along the thickness direction, of the mass spectroscopy device according to the fifth embodiment. In FIG. 9, elements and constituents equivalent to the corresponding elements or constituents in the first embodiment are indicated by the same reference numbers as the first embodiment, and descriptions of the equivalent elements or constituents are not repeated in the following explanations unless necessary.

As illustrated in FIG. 9, the mass spectroscopy device 5 according to the fifth embodiment has a structure constituted by a first reflector 10-4, a transparent body 20-4, and a second reflector 30-4. The first reflector 10-4 is arranged on the light-injection side (the upper side in FIG. 9) of the transparent body 20-4, and the second reflector 30-4 is arranged on the opposite side of the transparent body 20-4. The first reflector 10-4 is partially transparent and partially reflective, and the second reflector 30-4 is reflective. The (upper) surface of the first reflector 10-4 is a specimen-contact surface 5*s* of the mass spectroscopy device 5, with which a specimen is to be arranged in contact.

The mass spectroscopy device 5 according to the fifth embodiment is different from the first embodiment in that the first reflector 10-4 is realized by a columnar film 17 formed on the upper surface 20*s*-1 of the transparent body 20-4. The columnar film 17 is constituted by a great number of columns 17*p* which extend approximately parallel to each other and nonparallel to the upper surface 20*s*-1 of the transparent body 20-4. The transparent body 20-4 and the second reflector 30-4 in the fifth embodiment are similar to the transparent body 20 and the second reflector 30 in the first embodiment.

The material of the columnar film 17 is not specifically limited as long as the material is metal. The columnar film 17 may be formed of any of the examples which are mentioned before as the material of the first reflector 10 in the first embodiment. Although the columnar film 17 is formed of metal, the columnar film 17 contains a plurality of gaps 17*s* between the columns 17*p*. Therefore, the columnar film 17 is partially transparent and partially reflective. The diameters r of the columns 17*p* and the density of the gaps 17*s* are designed so that the columnar film 17 has a structure of protrusions and recesses which is finer than the wavelength of the measurement light L1. Therefore, the first reflector 10-4 is a thin film exhibiting a mesh electromagnetic shield effect as well as the partially transparent and partially reflective characteristics.

The manner of formation of the columnar film 17 is not specifically limited, and may be, for example, vapor phase deposition such as CVD (chemical vapor deposition) or sputtering. Although it is sufficient that the columns 17*p* extend nonparallel to the upper surface 20*s*-1 of the transparent body 20-4, it is preferable that the columns 17*p* extend along a direction which makes an angle in the range of 90±15 degrees with the upper surface 20*s*-1, and it is more preferable that the columns 17*p* extend along a direction which makes an angle in the range of 90±10 degrees with the upper surface 20*s*-1.

In addition, the columnar film 17 preferably has gaps 17*s* between the columns 17*p*. However, when the columnar film 17 is formed by vapor phase deposition so that the columns 17*p* extend along a direction which makes an angle of 90 degrees with the upper surface 20*s*-1, the gaps 17*s* are likely to be closed. Therefore, it is preferable that the angle between the upper surface 20*s*-1 and the direction along which the columns 17*p* grow not be 90 degrees. Thus, it is preferable that the columnar film 17 be formed by the oblique-incidence evaporation. Nevertheless, when the thickness of the columnar film 17 is sufficiently small, the columnar film 17 exhibits transparency even when the columnar film 17 do not have sufficient gaps 17*s*.

The thickness of the columnar film 17 is not specifically limited as long as the columnar film 17 has the partially transparent and partially reflective characteristics. The lengths of the columns 17*p* are not specifically limited. When the lengths of the columns 17*p* are in the range of 30 to 500 nm, it is possible to form the columnar film 17 having the partially transparent and partially reflective characteristics and containing sufficient gaps 17*s* regardless of the angle which the direction of the growth of the columns 17*p* makes with the upper surface 20*s*-1 of the transparent body 20-4.

Similar to the mass spectroscopy devices 1, 2, 3, and 4 according to the first, second, third, and fourth embodiments, the electric field on the specimen-contact surface 5*s* (i.e., the upper surface of the first reflector 10-4) in the mass spectroscopy device 5 is intensified when the mass spectroscopy device 5 is irradiated with the measurement light L1, and the energy of the measurement light L1 is increased on the specimen-contact surface 5*s*, so that the increased energy enables desorption of the analyte S from the specimen-contact surface 5*s*. Thus, mass spectroscopy of the analyte S is enabled.

The diameters r of the columns 17*p* and the density of the gaps 17*s* are not specifically limited as long as the columnar film 17 has a structure of protrusions and recesses which is finer than the wavelength of the measurement light L1. However, in the case where the measurement light L1 is visible light, it is preferable that the columnar film 17 has a structure of protrusions and recesses as fine as 200 nm or less. It is preferable that the regularity in the structure of the first reflector 10-4 be high, since the high regularity in the structure of the first reflector 10-4 increases the in-plane uniformity of the resonance structure and intensifies the characteristics of the mass spectroscopy device 5. Therefore, it is preferable that the gaps 17*s* be uniformly distributed over the first reflector 10-4. Although the diameters r of the columns 17*p* are not specifically limited, generally, it is more preferable that the columns 17*p* have smaller diameters r. Specifically, it is preferable that the diameters r of the columns 17*p* not exceed the mean free path of the electrons which vibrate in metal by the action of the light. The diameters r of the columns 17*p* are preferably equal to or smaller than 50 nm, and more preferably equal to or smaller than 30 nm.

Similar to the mass spectroscopy devices 1, 2, 3, and 4 according to the first, second, third, and fourth embodiments, in the mass spectroscopy device 5 according to the fifth embodiment, part of the measurement light L1 passes through the first reflector 10-4, enters the transparent body 20-4, and is multiply reflected between the first reflector 10-4 and the second reflector 30-4, so that the multiply reflected light effectively causes multiple interference and resonance at a specific wavelength satisfying a resonant condition. The resonance absorbs the light at the resonant wavelength, and intensifies the electric field in the mass spectroscopy device 5. That is, the effect of intensifying the electric field on the specimen-contact surface 5*s* works. As in the mass spectroscopy device 1 according to the first embodiment, the resonant wavelength in the mass spectroscopy device 5 also varies with the average refractive index and the thickness of the transparent body 20-4. Therefore, it is possible to achieve the effect of highly intensifying the electric field at the resonant wavelength (e.g., by the factor of 100 or more).

Since the mass spectroscopy device 5 according to the fifth embodiment is basically similar to the mass spectroscopy device 1 according to the first embodiment except that the first reflector 10-4 is realized by the columnar film 17. Therefore, the mass spectroscopy device 5 has similar advantages to the mass spectroscopy device 1 according to the first embodiment, and the mass spectroscopy device 5 enables highly precise mass spectroscopy when surface modification similar to the surface modification R in the first embodiment illustrated in FIG. 2A is applied to the surface of the first reflector 10-4.

6. Variations of Fifth Embodiment

In the mass spectroscopy device 5 according to the fifth embodiment, the first reflector 10-4 formed on the upper surface 20*s*-1 of the transparent body 20-4 is realized by a columnar film 17 of metal, the columnar film 17 is constituted by the columns 17*p*, and the columns 17*p* extend approximately parallel to each other and nonparallel to the upper surface 20*s*-1. However, the mass spectroscopy device 5 according to the fifth embodiment may be modified as explained below with reference to FIGS. 10 to 14.

6.1 First Variation

Figure 10:
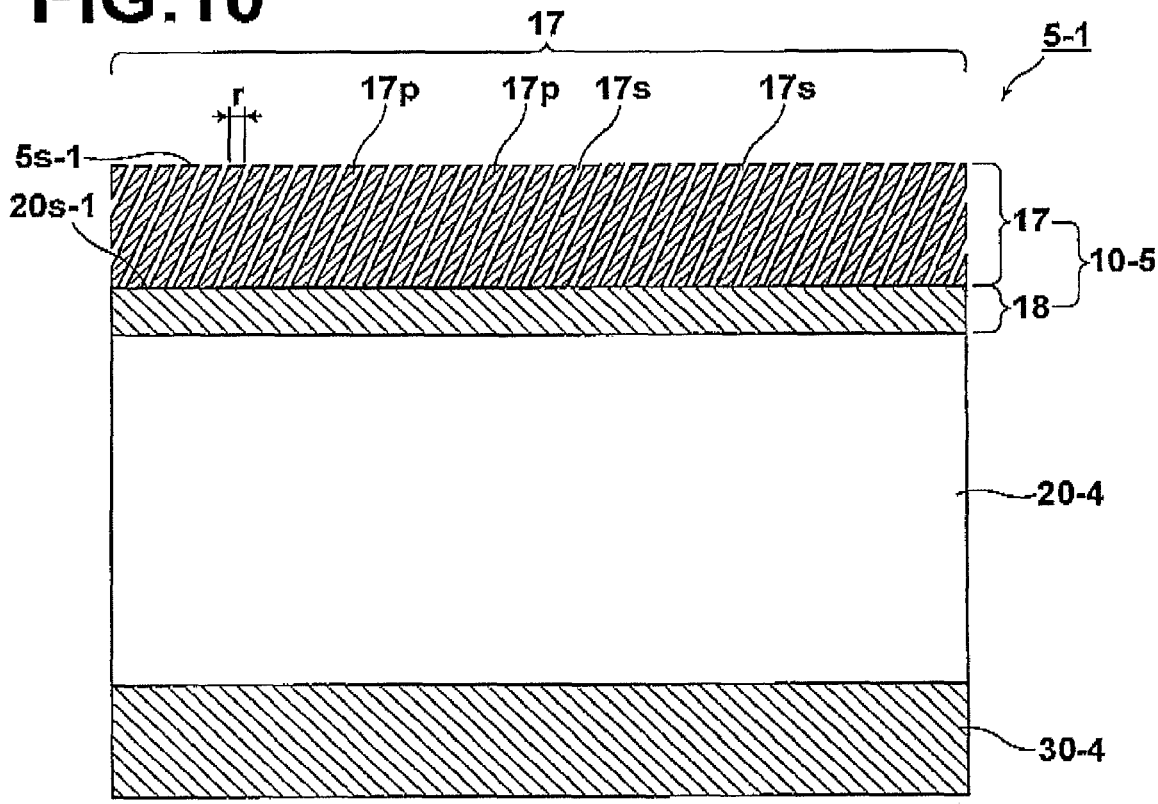
FIG. 10 is a cross-sectional view illustrating a cross section, along the thickness direction, of a first preferable variation of the mass spectroscopy device according to the fifth embodiment.

FIG. 10 is a cross-sectional view illustrating a cross section, along the thickness direction, of a first preferable variation of the mass spectroscopy device according to the fifth embodiment. As illustrated in FIG. 10, the mass spectroscopy device 5-1 as the first variation of the fifth embodiment is different from the mass spectroscopy device 5 according to the fifth embodiment (illustrated in FIG. 9) in that the first reflector 10-5 in the mass spectroscopy device 5-1 comprises a partially reflective film 18 as well as a columnar film 17 (which is similar to the columnar film 17 in the mass spectroscopy device 5 illustrated in FIG. 9). The partially reflective film 18 is formed between the transparent body 20-4 and the aforementioned columnar film 17, and is partially transparent and partially reflective. In the mass spectroscopy device 5-1, the multiple reflection can more effectively occur in the optical resonator. For example, the partially reflective film 18 may be a metal thin film, a multilayer dielectric thin film, or the like. In the multilayer dielectric thin film, layers of dielectric materials such as $MgF_2$, $SiO_2$, $TiO_2$, and the like are laminated.

6.2 Second and Third Variations

Figure 11:
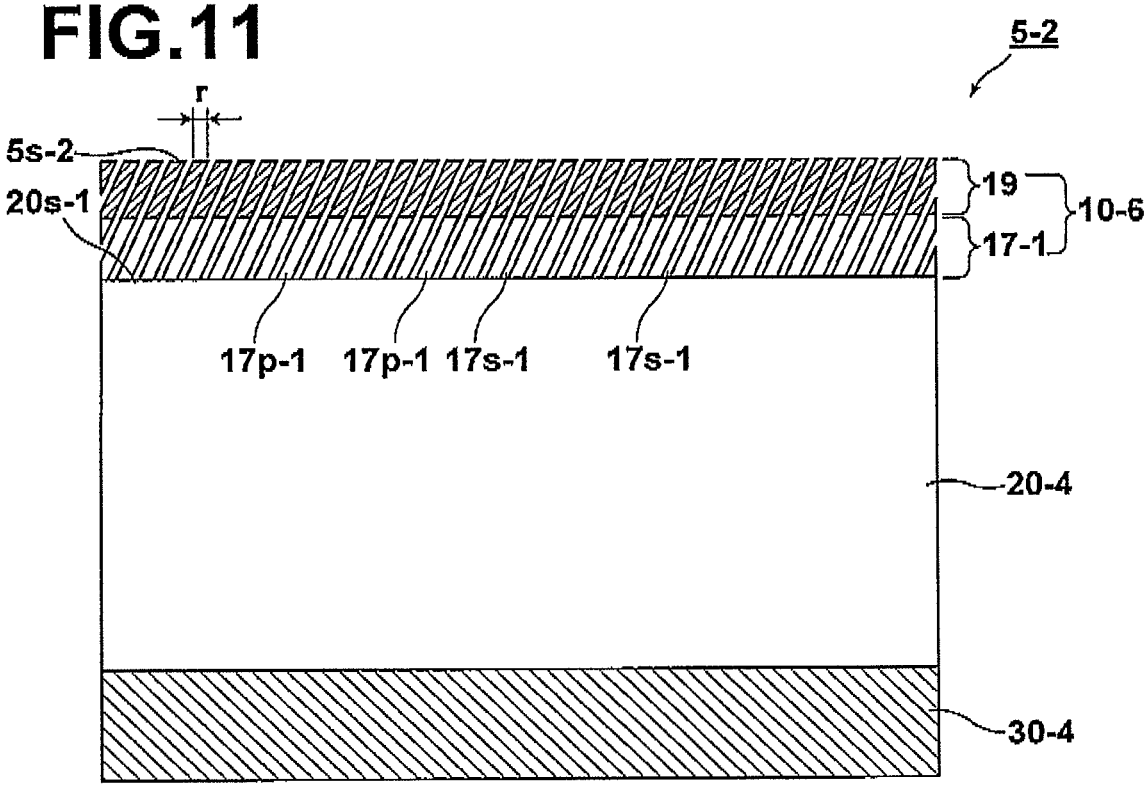
FIG. 11 is a cross-sectional view illustrating a cross section, along the thickness direction, of a second preferable variation of the mass spectroscopy device according to the fifth embodiment.

FIG. 11 is a cross-sectional view illustrating a cross section, along the thickness direction, of a second preferable variation of the mass spectroscopy device according to the fifth embodiment. As illustrated in FIG. 11, the mass spectroscopy device 5-2 as the second variation of the fifth embodiment is different from the mass spectroscopy device 5 according to the fifth embodiment (illustrated in FIG. 9) in that the first reflector 10-6 in the mass spectroscopy device 5-2 comprises a columnar film 17-1 and a metal film 19 which is formed on the columnar film 17-1. Similar to the columnar film 17 in the mass spectroscopy device 5 according to the fifth embodiment, the columnar film 17-1 is also constituted by a plurality of columns 17*p*-1, and the columns 17*p*-1 extend approximately parallel to each other and nonparallel to the upper surface 20*s*-1 of the transparent body 20-4. However, the columnar film 17-1 is formed of a dielectric material.

Figure 12:
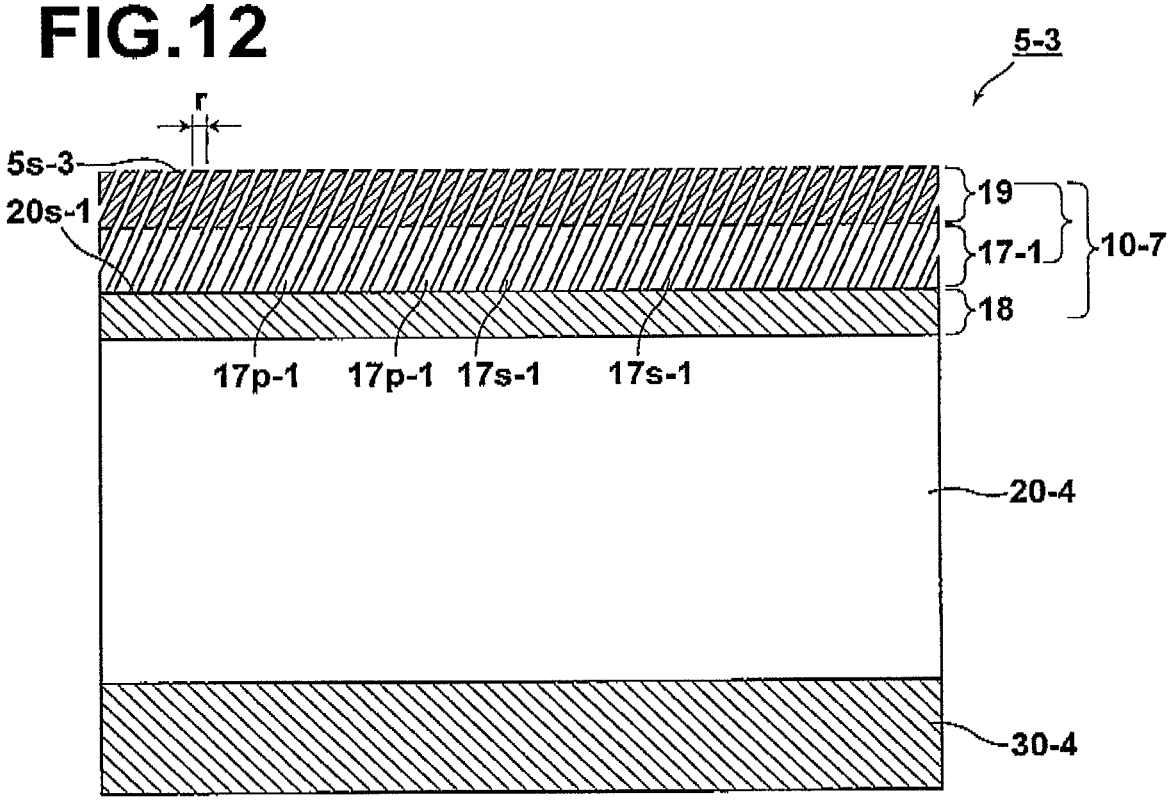
FIG. 12 is a cross-sectional view illustrating a cross section, along the thickness direction, of a third preferable variation of the mass spectroscopy device according to the fifth embodiment.

In addition, FIG. 12 is a cross-sectional view illustrating a cross section, along the thickness direction, of a third preferable variation of the mass spectroscopy device according to the fifth embodiment. As illustrated in FIG. 12, the mass spectroscopy device 5-3 as the third variation of the fifth embodiment is different from the mass spectroscopy device 5 as the fifth embodiment (illustrated in FIG. 9) in that the first reflector 10-7 in the mass spectroscopy device 5-3 comprises a columnar film 17-1, a partially reflective film 18, and a metal film 19. The columnar film 17-1 in the mass spectroscopy device 5-3 is similar to the columnar film 17-1 in the mass spectroscopy device 5-2 as the second variation of the fifth embodiment, the partially reflective film 18 in the mass spectroscopy device 5-3 is similar to the partially reflective film 18 in the mass spectroscopy device 5-1 as the first variation of the fifth embodiment, and the metal film 19 in the mass spectroscopy device 5-3 is similar to the metal film 19 in the mass spectroscopy device 5-2 as the second variation of the fifth embodiment. The partially reflective film 18 is formed on the upper surface 20*s*-1 of the transparent body 20-4, the columnar film 17-1 is formed on the partially reflective film 18, and the metal film 19 is formed on the columnar film 17-1.

In the case where a columnar film is formed by the oblique-incidence evaporation, dielectric films can be formed more easily than metal films. In addition, when a metal film is formed on a dielectric film having a columnar structure, the metal film can be relatively easily grown as extensions of the dielectric columns constituting the columnar structure of the dielectric film. Therefore, it is preferable that the metal film 19 be formed on the columnar film 17. In this case, the metal film 19 may or may not have a columnar structure. In either case, the gaps 17*s*-1 in the columnar film 17-1 are also approximately extended in the metal film 19. It is preferable that the columnar film 17-1 is formed of an inorganic dielectric material, since columnar films of inorganic dielectric material are easy to form, and resistant to heat and light. However, when a columnar film constituted by satisfactory columns can also be formed of an organic dielectric material, and the mass spectroscopy device 5-2 or 5-3 is used in applications in which the organic dielectric material does not cause a problem, the columnar film 17-1 may be formed of the organic dielectric material. In this case, plasma chemical deposition, molecular-beam evaporation, or the like can be used for formation of the columnar film 17-1.

6.3 Fourth and Fifth Variations

Figure 13:
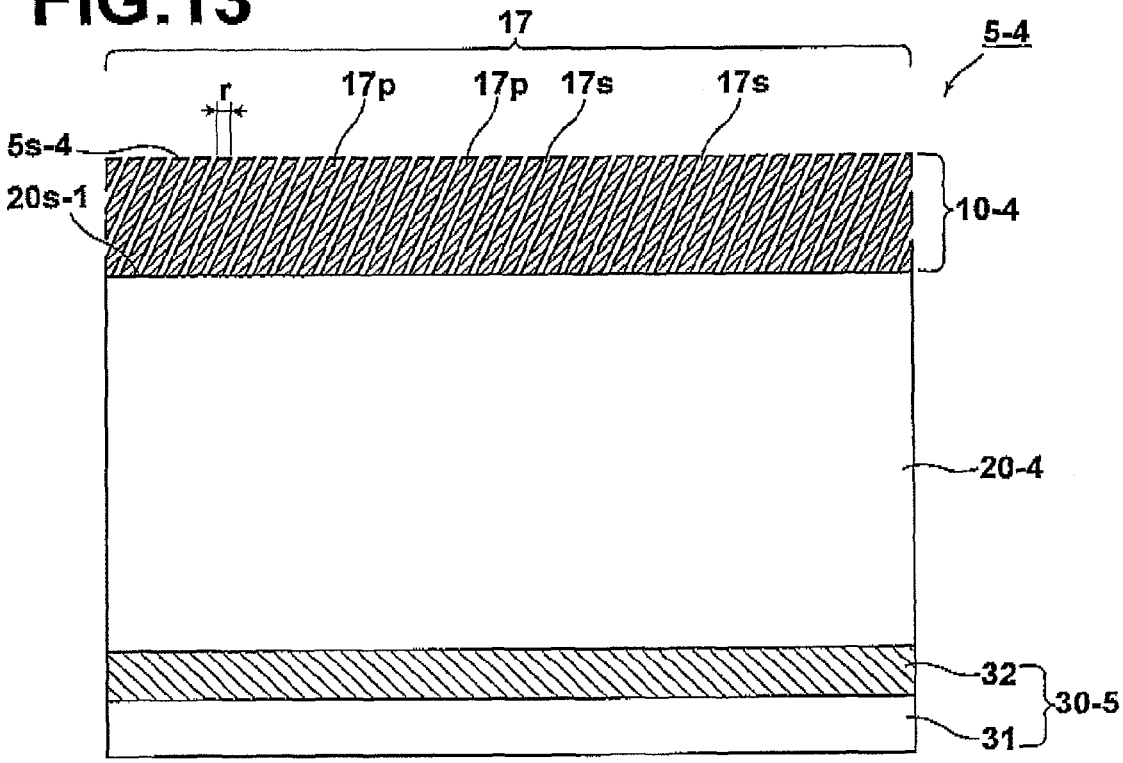
FIG. 13 is a cross-sectional view illustrating a cross section, along the thickness direction, of a fourth preferable variation of the mass spectroscopy device according to the fifth embodiment.

FIG. 13 is a cross-sectional view illustrating a cross section, along the thickness direction, of a fourth preferable variation of the mass spectroscopy device according to the fifth embodiment. As illustrated in FIG. 13, the mass spectroscopy device 5-4 as the fourth variation of the fifth embodiment is different from the mass spectroscopy device 5 according to the fifth embodiment (illustrated in FIG. 9) in that the second reflector 30-5 comprises a transparent film 31 and a partially reflective film 32.

Figure 14:
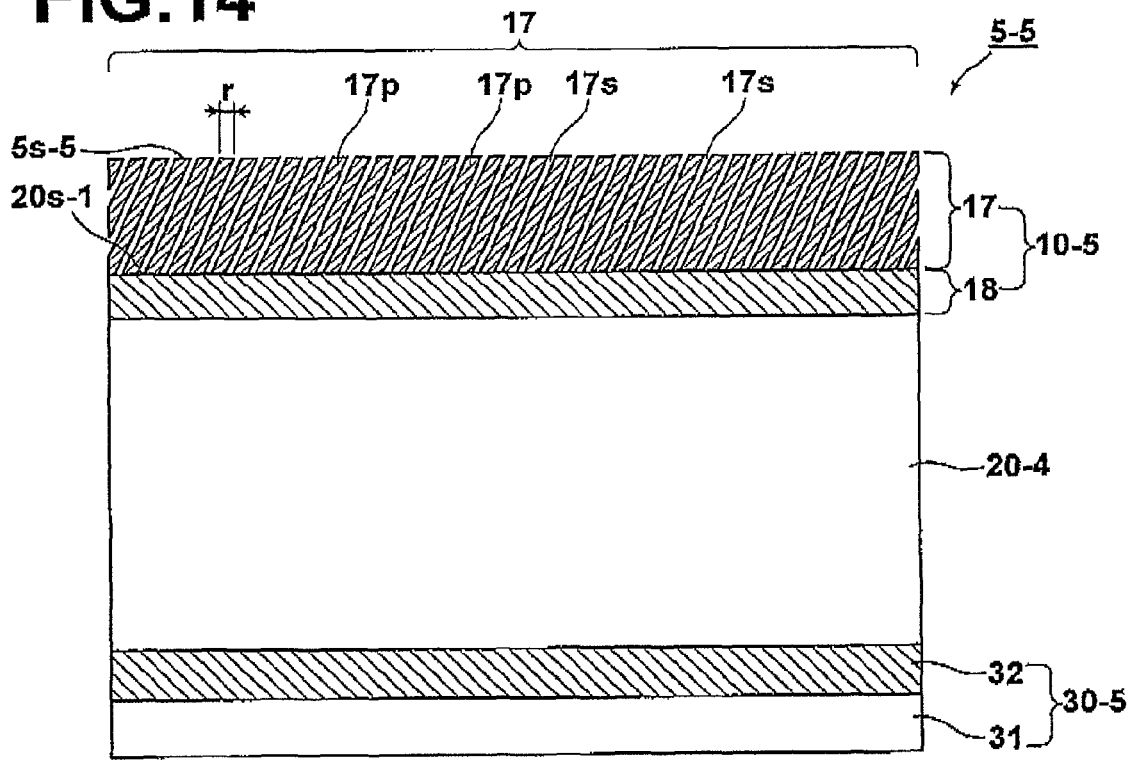
FIG. 14 is a cross-sectional view illustrating a cross section, along the thickness direction, of a fifth preferable variation of the mass spectroscopy device according to the fifth embodiment.

In addition, FIG. 14 is a cross-sectional view illustrating a cross section, along the thickness direction, of a fifth preferable variation of the mass spectroscopy device according to the fifth embodiment. As illustrated in FIG. 14, the mass spectroscopy device 5-5 as the fifth variation of the fifth embodiment is also a variation of the mass spectroscopy device 5-1 illustrated in FIG. 10, and is different from the mass spectroscopy device 5-1 (illustrated in FIG. 10) in that the second reflector 30-5 comprises a transparent film 31 and a partially reflective film 32.

In each of the mass spectroscopy devices 5-4 and 5-5 illustrated in FIGS. 13 and 14, the partially reflective film 32 is formed on the back surface of the transparent body 20-4, and the transparent film 31 is formed on the partially reflective film 32. The partially reflective film 32 is partially transparent and partially reflective. The partially reflective film 32 can be formed in a similar manner to the partially reflective film 18 in the first variation of the fifth embodiment illustrated in FIG. 10. Since the second reflector 30-5 is formed as above, the second reflector 30-5 is partially transparent and partially reflective. Therefore, the mass spectroscopy devices 5-4 and 5-5 illustrated in FIGS. 13 and 14 have a further advantage that the light outputted through the second reflector 30-5 can also be used.

Further, the second reflector 30-4 in each of the mass spectroscopy devices 5-2 and 5-3 may also be replaced with the second reflector 30-5 constituted by the transparent film 31 and the partially reflective film 32.

6.4. Other Applications

The microstructures having similar constructions to the mass spectroscopy device according to the fifth embodiment and the variations of the fifth embodiment can also be used in applications other than the mass spectroscopy devices. That is, such microstructures can be used in various devices which take advantage of light absorption associated with resonance occurring in an optical resonator when the columnar film is irradiated with measurement light L1 from the first-reflector side. For example, such devices include a device which increases the energy of light to be detected, by the effect of intensifying the electric field associated with the light absorption, or a device which performs sensing by using a change in the optical absorption characteristic at the resonant wavelength.

7. Other Variations

In the mass spectroscopy devices according to the first to fifth embodiments, each of or the combination the first reflector and the second reflector can be changed appropriately when necessary. For example, it is possible to produce a mass spectroscopy device according to the present invention by appropriately choosing and combining one or more of the features of the first and second reflectors in the first to fifth embodiments.

8. Sixth Embodiment

A mass spectroscopy system in which the mass spectroscopy device 1 according to the first embodiment of the present invention is used is explained below as the sixth embodiment of the present invention with reference to FIG. 15, which is a diagram schematically illustrating an outline of a construction of the mass spectroscopy system 6 according to the sixth embodiment. The mass spectroscopy system 6 of FIG. 15 performs the time-of-flight mass spectroscopy (TOF-MS). Although the mass spectroscopy device 1 according to the first embodiment is used in the mass spectroscopy system 6 of FIG. 15, even in the case where any of the mass spectroscopy devices according to the second to fifth embodiments is used instead of the mass spectroscopy device 1, it is possible to obtain similar advantages to the advantages obtained in the case where the mass spectroscopy device 1 is used.

Figure 15:
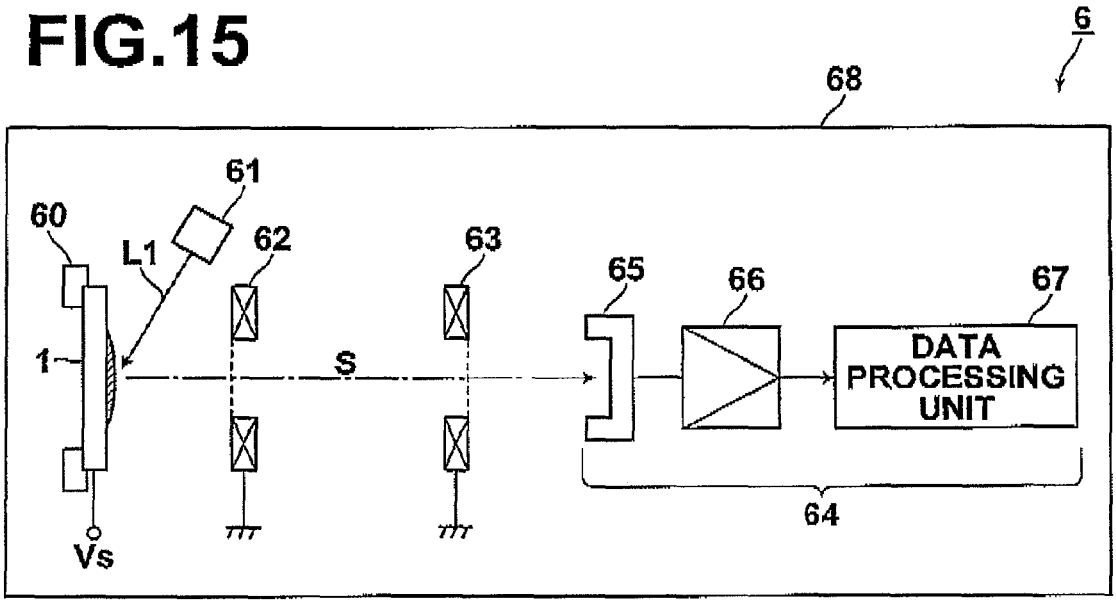
FIG. 15 is a diagram schematically illustrating an outline of a construction of a mass spectroscopy system according to the sixth embodiment.

As illustrated in FIG. 15, the mass spectroscopy system 6 is constituted by the mass spectroscopy device 1, a device holder 60, an irradiation unit 61, an extraction grid 62, an end plate 63, an analysis unit 64, and a vacuum chamber 68.

The device holder 60 holds the mass spectroscopy device 1. The irradiation unit 61 applies measurement light L1 to a specimen which is arranged in contact with the specimen-contact surface is of the first reflector 10 in the mass spectroscopy device 1, and desorbs an analyte S (which is to be analyzed by the mass spectroscopy and is contained in the specimen) from the specimen-contact surface 1*s*. The analysis unit 64 detects the desorbed analyte S, and performs mass spectroscopy of the analyte S. The extraction grid 62 and the analysis unit 64 are arranged between the mass spectroscopy device 1 and the analysis unit 64. The extraction grid 62 is placed so that a first side of the extraction grid 62 faces the specimen-contact surface Is of the mass spectroscopy device 1, and the analysis unit 64 is placed so as to face a second side (opposite to the first side) of the extraction grid 62. The vacuum chamber 68 contains the mass spectroscopy device 1, the device holder 60, the irradiation unit 61, the extraction grid 62, the end plate 63, and the analysis unit 64, and the inside of the vacuum chamber 68 is maintained in a vacuum.

Specifically, the irradiation unit 61 comprises a monochromatic light source (e.g., a laser-light source), and may further comprise a light-guiding optical system (including, for example, a mirror). The monochromatic light source is, for example, a pulsed laser with the wavelength of 337 nm and the pulse width of approximately 50 picoseconds to 50 nanoseconds.

In outline, the analysis unit 64 comprises a detector unit 65, an amplifier 66, and a data processing unit 67. The detector unit 65 detects the analyte S which has been desorbed from the specimen-contact surface 1*s* of the mass spectroscopy device 1 by the irradiation with the measurement light L1 and flown through the central holes of the extraction grid 62 and the end plate 63. The amplifier 66 amplifies the output of the detector unit 65, and the data processing unit 67 processes the output signal of the amplifier 66.

In the mass spectroscopy system 6 having the above construction, mass spectroscopy of the analyte S is performed as follows.

First, the specimen containing the analyte S is arranged in contact with the specimen-contact surface 1*s* of the mass spectroscopy device 1, and the voltage Vs is applied to the mass spectroscopy device 1. In response to a predetermined start signal, the irradiation unit 61 irradiates the specimen-contact surface 1*s* of the mass spectroscopy device 1 with the measurement light L1. Then, the electric field on the specimen-contact surface 1*s* is intensified, so that the energy of the measurement light L1 is increased and desorbs the analyte S in the specimen from the specimen-contact surface 1*s*.

The desorbed analyte S is extracted toward the extraction grid 62 and accelerated by the potential difference Vs between the mass spectroscopy device 1 and the extraction grid 62. The analyte S approximately straightly flies through the central hole of the extraction grid 62 toward the end plate 63, passes through the central hole of the end plate 63, and reaches the detector unit 65, which detects the analyte S.

The analyte S may be ionized before being arranged in contact with the mass spectroscopy device 1. After the desorption, the analyte S may be ionized, or combined with another material (e.g., part of the surface modification of the mass spectroscopy device 1). The flying speed of the analyte S after the desorption depends on the mass of the analyte S, and is greater when the mass of the analyte S is smaller. Therefore, the detector unit 65 detects different materials in increasing order of mass.

The output signal from the detector unit 65 is amplified to a predetermined level by the amplifier 66, and is then inputted in the data processing unit 67. A synchronization signal synchronized with the aforementioned start signal is also inputted in the data processing unit 67. Since the flying time of the analyte S can be obtained on the basis of the synchronizing signal and the output signal from the amplifier 66, it is possible to obtain a mass spectrum by deriving the mass from the flying time.

Since the mass spectroscopy system 6 according to the sixth embodiment uses the mass spectroscopy device 1, the mass spectroscopy system 6 has similar advantages to the mass spectroscopy device 1.

In the above construction of the mass spectroscopy system 6, all the components of the mass spectroscopy system 6 are contained in the vacuum chamber 68. However, the components except the mass spectroscopy device 1, the extraction grid 62, the end plate 63, and the vacuum chamber 68 may not be contained in the vacuum chamber 68.

Although the mass spectroscopy system 6 according to the sixth embodiment performs the time-of-flight mass spectroscopy (TOF-MS), the mass spectroscopy system according to the present embodiment can be used in the other types of mass spectroscopy.

9. Seventh Embodiment

Another mass spectroscopy system in which the mass spectroscopy device 1 according to the first embodiment of the present invention is used is explained below as the seventh embodiment of the present invention with reference to FIG. 16, which is a diagram schematically illustrating an outline of a construction of the mass spectroscopy system 7 according to the seventh embodiment. Although the mass spectroscopy device 1 according to the first embodiment is used in the mass spectroscopy system 7 of FIG. 16, even in the case where any of the mass spectroscopy devices according to the second to fifth embodiments is used instead of the mass spectroscopy device 1, it is possible to obtain similar advantages to the advantages obtained in the case where the mass spectroscopy device 1 is used.

Figure 16:
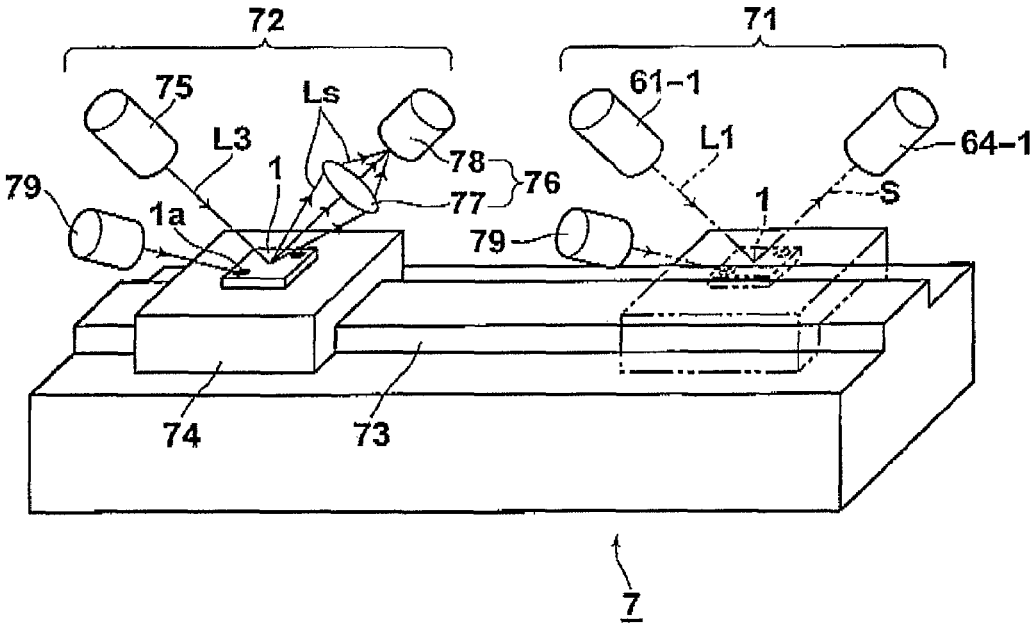
FIG. 16 is a perspective view schematically illustrating an outline of a construction of a mass spectroscopy system according to the seventh embodiment.

As illustrated in FIG. 16, in outline, the mass spectroscopy system 7 is constituted by a mass spectroscope unit 71, a sensing unit 72, a rail 73, and a stage 74. The mass spectroscopy device 1 is set on the stage 74, the rail 73 extends from the sensing unit 72 to the mass spectroscope unit 71, and the stage 74 can be moved along the rail 73.

In the mass spectroscopy system 7, the sensing unit 72 detects the existence or absence of the analyte S in a specimen. When the analyte S is detected in the specimen, the stage 74 is moved along the rail 73 to the mass spectroscope unit 71, and the mass spectroscope unit 71 performs mass spectroscopy of the analyte S in the specimen.

When the mass spectroscopy device 1 is irradiated with measurement light L1, the mass spectroscopy device 1 can effectively intensify the electric field on the specimen-contact surface 1*s*. Therefore, the mass spectroscopy device 1 can also be used as a sensing device taking advantage of the effect of intensifying the electric field on the specimen-contact surface 1*s*. For example, the SERS-active devices used in Raman spectroscopy are devices which utilize the surface-enhanced Raman scattering (SERS) effect. The SERS-active devices can increase the sensitivity to Raman-scattered light by taking advantage of the effect of intensifying the electric field on a specimen-contact surface and intensifying weak Raman-scattered light. Therefore, the mass spectroscopy device 1 can also be preferably used as a SERS-active device. In the mass spectroscopy system 7 of FIG. 16, the sensing unit 72 is a Raman spectroscopy device which utilizes the SERS effect.

In outline, the sensing unit 72 is constituted by a first irradiation unit 75 and a spectroscopy (detection) unit 76. The first irradiation unit 75 applies detection light L3 at a specific wavelength to a specimen which is arranged in contact with the specimen-contact surface 1*s* of the first reflector 10 in the mass spectroscopy device 1, intensifies the electric field on the specimen-contact surface 1*s*, and produces scattered light Ls. The spectroscope unit 76 performs spectroscopy of the scattered light Ls which is intensified by the electric field on the specimen-contact surface 1*s*, and detects the presence or absence of the analyte S in the specimen.

The first irradiation unit 75 comprises a monochromatic light source (e.g., a laser-light source), and may further comprise a light-guiding optical system (including, for example, a mirror). The first irradiation unit 75 is designed to irradiate the specimen-contact surface 1*s* with the detection light L3 at the specific wavelength. In Raman spectroscopy, the wavelength at which the Raman shift is observed varies with the analyte S. Therefore, the wavelength of the monochromatic light source is chosen according to the analyte S.

The spectroscope unit 76 is arranged so that the scattered light Ls produced on the specimen-contact surface 1*s* of the mass spectroscopy device 1 enters the spectroscope unit 76. The spectroscope unit 76 comprises a spectroscopic detector 78 and a condensing lens 77 which collects the scattered light Ls. The spectroscope unit 76 may further comprise a light-guiding element such as a mirror for guiding to the spectroscopic detector 78 the scattered light Ls collected by the condensing lens 77.

Thus, in the sensing unit 72, the first irradiation unit 75 applies the detection light L3 (at the specific wavelength) to specimen-contact surface 1*s* with which the specimen is arranged in contact, the detection light L3 is scattered at the specimen-contact surface is, so that the scattered light Ls is produced. The scattered light Ls enters the spectroscope unit 76, and the spectroscope unit 76 separates the scattered light Ls into the spectral components of the scattered light Ls, and obtains a Raman spectrum. Since the Raman spectrum varies with the material as mentioned before, it is possible to detect the presence or absence of the analyte S on the basis of the presence or absence of the Raman shift uniquely corresponding to the analyte S.

In outline, the mass spectroscope unit 71 is constituted by a second irradiation unit 61-1 and an analysis unit 64-1. The second irradiation unit 61-1 applies measurement light L1 to the specimen, which is arranged in contact with the specimen-contact surface 1*s* of the mass spectroscopy device 1 (set on the stage 74), and desorbs the analyte S from the specimen-contact surface 1*s*. The analysis unit 64-1 detects the desorbed analyte S, and performs mass spectroscopy of the analyte S.

Although the manner of mass spectroscopy performed by the mass spectroscope unit 71 is not specifically limited, it is preferable that the mass spectroscopy be performed in such a manner that the effect of intensifying the electric field in the mass spectroscopy device 1 can be effectively utilized. In the case where the mass spectroscopy system 7 of FIG. 16 performs the time-of-flight mass spectroscopy (TOF-MS), the mass spectroscope unit 71 may have an approximately similar construction to the mass spectroscopy system 6 illustrated in FIG. 15. However, since, in the mass spectroscopy system 7 of FIG. 16, the mass spectroscopy of the analyte S is performed after the analyte S is sensed by the sensing unit 72, it is preferable that the place on which the stage 74 (corresponding to the device holder 60 in FIG. 15) is set and the second irradiation unit 61-1 (corresponding to the irradiation unit 61 in FIG. 15) be arranged outside the vacuum chamber. In this case, the mass spectroscopy device 1 set on the stage 74 can be easily moved along the rail 73.

When the second irradiation unit 61-1 in the mass spectroscope unit 71 applies the measurement light L1 to the same position of the specimen as the positions to which the first irradiation unit 75 in the sensing unit 72 applies the detection light L3, it is possible to perform mass spectroscopy of the analyte S without an error. Therefore, in order to correctly determine the positions to which the measurement light L1 and L3 are applied, it is preferable that a position marking 1*a* for identifying the position at which the specimen is to be analyzed be arranged at a position which can be detected from outside, and each of the sensing unit 72 and the mass spectroscope unit 71 comprises a positioning means 79 for making the positions to which the measurement light L1 and L3 are applied coincide.

It is preferable that the mass spectroscopy device 1 used in the mass spectroscopy system 7 effectively achieve the surface-enhanced Raman scattering (SERS) effect in the sensing unit 72, and the effect of intensifying the electric field in the mass spectroscope unit 71. Therefore, it is preferable that the average refractive index and the thickness of the transparent body 20 in the mass spectroscopy device 1 are designed so that the effect of intensifying the electric field can be effectively achieved when each of the measurement light L1 and L3 is applied to the mass spectroscopy device 1. Since the resonant wavelength varies with the average refractive index and the thickness of the transparent body 20 in the mass spectroscopy device 1 as indicated in the aforementioned approximate equation (1), the wavelength at which the effect of intensifying the electric field is achieved can be changed by a simple design change which changes only the average refractive index and the thickness of the transparent body 20. Therefore, the mass spectroscopy system 7 according to the seventh embodiment does not require complex device design, and can cope with various analytes.

Since the mass spectroscopy system 7 according to the seventh embodiment uses the mass spectroscopy device 1, the mass spectroscopy system 7 has similar advantages to the mass spectroscopy device 1.

10. Industrial Usability

The mass spectroscopy device according to the present invention can be used in mass spectroscopy systems for identifying materials, the mass spectroscopy system according to the present invention can be used for identifying materials, and the microstructure according to the present invention can be used in various devices which take advantage of light absorption associated with optical resonance.

What is claimed is:

1. A mass spectroscopy device comprising:

a first reflector which is partially transparent and partially reflective;

a transparent body; and a second reflector which is reflective;

wherein said first reflector and said second reflector are arranged on opposite sides of the transparent body so as to form an optical resonator in such a manner that when a specimen containing an analyte subject to mass spectroscopy is arranged in contact with a surface of said first reflector, and the surface is irradiated with measurement light, optical resonance occurs in the optical resonator, and intensifies an electric field on the surface, and the intensified electric field desorbs the analyte from the surface.

2. A mass spectroscopy device according to claim 1, wherein said specimen contains a mixture of said analyte and a matrix material, the analyte and the matrix material are desorbed from said surface and ionized when the surface is irradiated with the measurement light.

3. A mass spectroscopy device according to claim 1, wherein said analyte is ionized and desorbed from said surface when the surface is irradiated with the measurement light.

4. A mass spectroscopy device according to claim 1, wherein said first reflector has a structure of protrusions and recesses which is finer than a wavelength which said measurement light has.

5. A mass spectroscopy device according to claim 4, wherein said first reflector is constituted by a metal layer formed in a pattern on a surface of said transparent body.

6. A mass spectroscopy device according to claim 4, wherein said first reflector is constituted by a metal layer which is formed with noncohesive metal particles fixed to a surface of said transparent body.

7. A mass spectroscopy device according to claim 4, wherein said transparent body is constituted by a transparent microporous body having micropores which are open at ends of the micropores nearer to the first reflector, the micropores have diameters smaller than a wavelength which the measurement light has, and said first reflector is constituted by a metal layer having microholes formed in a pattern corresponding to a surface profile of the transparent body.

8. A mass spectroscopy device according to claim 7, wherein said transparent microporous body is realized by an anodically oxidized portion of a metal body, said second reflector is realized by an unoxidized portion of the metal body, and said metal layer is formed on the transparent body.

9. A mass spectroscopy device according to claim 7, wherein at least part of said micropores are filled with metal.

10. A mass spectroscopy device according to claim 9, wherein bottom portions of said micropores are filled with metal.

11. A mass spectroscopy device according to claim 4, wherein said transparent body is constituted by a transparent microporous body having micropores which are open at ends of the micropores nearer to the first reflector, metal microbodies are respectively fixed to said micropores, the metal microbodies are constituted by metal-filler portions and metal protrusions, the micropores are filled with metal-filler portions, and the metal protrusions are formed so as to protrude above a surface of the transparent body and have greater diameters than the metal-filler portions.

12. A mass spectroscopy device according to claim 11, wherein said transparent microporous body is realized by an anodically oxidized portion of a metal body, said second reflector is realized by an unoxidized portion of the metal body, and said first reflector is realized by said metal protrusions.

13. A mass spectroscopy device according to claim 4, wherein said first reflector comprises a columnar metal film formed on a surface of the transparent body, and the columnar metal film is constituted by a plurality of columns which extend approximately parallel to each other and nonparallel to the surface of the transparent body.

14. A mass spectroscopy device according to claim 4, wherein said first reflector comprises a columnar dielectric film and a metal film, the columnar dielectric film is formed on a surface of the transparent body, and the columnar dielectric film is constituted by a plurality of columns which extend approximately parallel to each other and nonparallel to the surface of the transparent body, and the metal film is formed on the columnar dielectric film.

15. A mass spectroscopy device according to claim 1, wherein localized plasmon can be excited at at least said surface of the first reflector, and said measurement light contains a component having such a wavelength that the component can excite localized plasmon in the first reflector.

16. A mass spectroscopy device according to claim 1, wherein surface modification which can be combined with said analyte is applied to said surface of said first reflector, the surface modification is constituted by a first linker, a second linker, and a decomposer, the first linker is combined with the surface of said first reflector, and the second linker is combined with the analyte, the decomposer is interposed between the first linker and the second linker, and decomposed by an electric field generated by irradiation of the surface of said first reflector with said measurement light.

17. A mass spectroscopy device according to claim 1, wherein a position marking for identifying a target position at which the specimen is to be analyzed is arranged at a marking position which can be detected from outside.

18. A mass spectroscopy system comprising:

said mass spectroscopy device according to claim 1;

a first irradiation unit which applies said measurement light to said surface of said first reflector with which said specimen is arranged in contact, and desorbs said analyte from the surface; and an analysis unit which detects the desorbed analyte, and performs mass spectroscopy of the analyte.

19. A mass spectroscopy system according to claim 18, further comprising, a second irradiation unit which applies detection light to a target position on said surface of the first reflector with which said specimen is arranged in contact, and intensifies the electric field on the target position on the surface, and a detection unit which detects the presence or absence of the analyte in the specimen at the target position on the surface by using the intensified electric field, where said analysis unit performs mass spectroscopy of the analyte while applying the detection light to the target position on the surface.

20. A mass spectroscopy system according to claim 19, wherein a position marking for identifying said target position is arranged at a marking position which can be detected from outside, and said mass spectroscopy system further comprises a positioning means which makes a first position to which said measurement light is applied coincide with a second position to which said detection light by referring to the position marking.

21. A mass spectroscopy system according to claim 18, wherein said analysis unit performs time-of-flight mass spectroscopy.

22. A microstructure comprising:

a first reflector which is partially transparent and partially reflective;

a transparent body; and a second reflector which is reflective;

wherein said first reflector is realized by a columnar film formed on a surface of the transparent body, and the columnar film is constituted by a plurality of columns which extend approximately parallel to each other and nonparallel to the surface of the transparent body, and the first reflector and said second reflector are arranged on opposite sides of the transparent body so as to form an optical resonator in such a manner that optical resonance occurs in the optical resonator when a surface of the first reflector is irradiated with measurement light.

* * * * *